US010494858B2

(12) United States Patent
Shanahan et al.

(10) Patent No.: US 10,494,858 B2
(45) Date of Patent: Dec. 3, 2019

(54) INSULATED DOORS WITH RESTORABLE BREAKAWAY SECTIONS

(71) Applicant: Rite-Hite Holding Corporation, Milwaukee, WI (US)

(72) Inventors: Dean Shanahan, Dubuque, IA (US); Derek Lewan, Dubuque, IA (US); Jon Schumacher, Hubertus, WI (US); Nicholas J. Casey, Cascade, IA (US); Perry W. Knutson, Lancaster, WI (US); Rodney Kern, Dubuque, IA (US); Steven Campbell, Peosta, IA (US); Timothy A. Haessler, Dubuque, IA (US); William W. Hoerner, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 517 days.

(21) Appl. No.: 15/014,400

(22) Filed: Feb. 3, 2016

(65) Prior Publication Data

US 2017/0218683 A1 Aug. 3, 2017

(51) Int. Cl.
*E06B 3/50* (2006.01)
*E05F 15/643* (2015.01)
(Continued)

(52) U.S. Cl.
CPC ..... *E06B 3/5072* (2013.01); *E05D 1/00* (2013.01); *E05D 15/063* (2013.01);
(Continued)

(58) Field of Classification Search
CPC ..... F25D 23/021; E05Y 2900/102; E06B 3/5072; E06B 3/4636; E06B 3/481;
(Continued)

(56) References Cited

U.S. PATENT DOCUMENTS 1,220,910 A 3/1917 Toll
1,802,519 A 4/1931 Linstadt
(Continued)

FOREIGN PATENT DOCUMENTS

DE 2043581 4/1971
DE 202007008715 12/2007
(Continued)

OTHER PUBLICATIONS

International Searching Authority, "International Search Report and Written Opinion," issued in connection with PCT application No. PCT/US2017/015787, dated Jul. 27, 2017, 23 pages.
(Continued)

*Primary Examiner* — Gregory J Strimbu
(74) *Attorney, Agent, or Firm* — Hanley, Flight & Zimmerman, LLC.

(57) ABSTRACT

A door includes a panel assembly including a leading panel and a trailing panel. The leading panel is to be in substantially coplanar alignment with the trailing panel when the panel assembly is in a normal configuration. The leading panel is to be angularly displaced out of coplanar alignment with the trailing panel when the panel assembly is in a dislodged configuration. The door further includes a tension member to connect the leading panel to the trailing panel. The tension member is to resiliently urge the leading panel and the trailing panel toward each other in a horizontal direction. The tension member is to resiliently urge the panel assembly toward the normal configuration when the panel assembly is in the dislodged configuration.

24 Claims, 23 Drawing Sheets

(51) Int. Cl.

| | |
|---|---|
| ***E05D 1/00*** | (2006.01) |
| ***E05D 15/06*** | (2006.01) |
| ***E05D 15/12*** | (2006.01) |
| ***E05D 15/26*** | (2006.01) |
| ***E05D 15/54*** | (2006.01) |
| ***E06B 7/22*** | (2006.01) |
| ***F25D 13/00*** | (2006.01) |
| ***F25D 23/02*** | (2006.01) |
| ***E06B 3/46*** | (2006.01) |
| ***E06B 3/48*** | (2006.01) |
| ***E06B 3/80*** | (2006.01) |
| *E05D 15/48* | (2006.01) |

(52) U.S. Cl.
CPC ..... *E05D 15/0604* (2013.01); *E05D 15/12* (2013.01); *E05D 15/264* (2013.01); *E05D 15/54* (2013.01); *E05F 15/643* (2015.01); *E06B 3/4636* (2013.01); *E06B 3/481* (2013.01); *E06B 3/80* (2013.01); *E06B 7/22* (2013.01); *F25D 13/00* (2013.01); *F25D 23/021* (2013.01); *E05D 2015/485* (2013.01); *E05Y 2900/102* (2013.01)

(58) Field of Classification Search
CPC ... E05D 15/0604; E05D 15/581; E05D 15/58; E05D 15/264; E05D 2015/482
See application file for complete search history.

(56) References Cited

U.S. PATENT DOCUMENTS

| | | | | | |
|---|---|---|---|---|---|
| 2,514,370 | A * | 7/1950 | Bunnell | E06B 3/481 | 160/190 |
| 2,619,167 | A | 11/1952 | Eckel | | |
| 2,834,410 | A * | 5/1958 | Kuyper | E06B 3/481 | 160/183 |
| 2,878,532 | A | 3/1959 | Clark | | |
| 3,003,551 | A | 10/1961 | Ferris | | |
| 3,197,817 | A | 8/1965 | Voris | | |
| 3,277,950 | A * | 10/1966 | Stouffer | E06B 3/481 | 160/183 |
| 3,354,581 | A | 11/1967 | Dimmitt et al. | | |
| 3,407,536 | A | 10/1968 | Nystrom | | |
| 3,605,853 | A * | 9/1971 | Osborn | E05F 1/1066 | 160/118 |
| 3,611,637 | A | 10/1971 | Saino | | |
| 4,027,715 | A * | 6/1977 | Tohma | E06B 3/80 | 160/181 |
| 4,084,347 | A | 4/1978 | Brown | | |
| 4,387,760 | A | 6/1983 | Greschbach | | |
| 4,404,770 | A | 9/1983 | Markus | | |
| 4,503,637 | A | 3/1985 | Parente | | |
| 4,532,743 | A | 8/1985 | Miller et al. | | |
| 4,646,471 | A | 3/1987 | Shaiu | | |
| 4,651,469 | A | 3/1987 | Ngian et al. | | |
| 4,680,828 | A | 7/1987 | Cook et al. | | |
| 4,887,659 | A | 12/1989 | West | | |
| 4,953,611 | A | 9/1990 | Verstraten | | |
| 5,295,527 | A | 3/1994 | West | | |
| 5,351,442 | A | 10/1994 | Gingras | | |
| 5,727,614 | A * | 3/1998 | Lichy | E06B 9/581 | 160/201 |
| 5,967,160 | A | 10/1999 | Rochette et al. | | |
| 6,053,237 | A | 4/2000 | Bertilsson et al. | | |
| 6,330,763 | B1 | 12/2001 | Kern et al. | | |
| 6,360,487 | B1 | 3/2002 | Kern et al. | | |
| 6,470,952 | B1 | 10/2002 | Cline et al. | | |
| 6,834,703 | B2 | 12/2004 | Pacholke et al. | | |
| 6,851,464 | B2 | 2/2005 | Hudoba et al. | | |
| 7,155,861 | B2 | 1/2007 | Berry et al. | | |
| 7,296,608 | B2 * | 11/2007 | Weishar | E05D 15/54 | 160/200 |
| 8,205,387 | B2 | 6/2012 | Ranaudo et al. | | |
| 2002/0056236 | A1 | 5/2002 | Kalempa et al. | | |
| 2003/0140564 | A1 | 7/2003 | Delgado et al. | | |
| 2004/0172882 | A1 | 9/2004 | Kern et al. | | |
| 2004/0173327 | A1 * | 9/2004 | Steel | E05D 3/022 | 160/210 |
| 2004/0206004 | A1 | 10/2004 | Kalempa et al. | | |
| 2004/0231244 | A2 | 11/2004 | Kalempa et al. | | |
| 2004/0261318 | A1 | 12/2004 | Berry et al. | | |
| 2005/0005524 | A1 | 1/2005 | Berry et al. | | |
| 2005/0028946 | A1 | 2/2005 | Weishar et al. | | |
| 2005/0076570 | A1 | 4/2005 | Delgado et al. | | |
| 2005/0150169 | A1 | 7/2005 | Schulte et al. | | |
| 2006/0090401 | A1 | 5/2006 | Berry et al. | | |
| 2009/0084039 | A1 * | 4/2009 | Guering | B64C 1/14 | 49/109 |
| 2009/0151264 | A1 * | 6/2009 | Boens | E06B 7/36 | 49/383 |
| 2011/0011003 | A1 | 1/2011 | Vogel et al. | | |
| 2012/0000129 | A1 | 1/2012 | Kuznetsov | | |

FOREIGN PATENT DOCUMENTS

| | | |
|---|---|---|
| EP | 0163942 | 11/1985 |
| EP | 1935286 | 6/2008 |
| WO | 9519486 | 7/1995 |
| WO | 0118469 | 3/2001 |
| WO | 03052226 | 6/2003 |
| WO | 2006100394 | 9/2006 |

OTHER PUBLICATIONS

International Searching Authority, "Invitation to pay additional fees," issued in connection with PCT application No. PCT/US2017/015787, dated Apr. 26, 2017, 16 pages.

IP Australian Government, "Examination Report No. 1 for standard patent application", Issued in connection with Australian patent application No. 273214, dated Aug. 30, 2019, 5 pages.

China National Intellectual Property Administration, "First Office Action" issued in connection with Chinese patent application No. 201780020927.3, dated Sep. 16, 2019, (7 pages).

* cited by examiner

INSULATED DOORS WITH RESTORABLE BREAKAWAY SECTIONS

FIELD OF THE DISCLOSURE

This patent generally pertains to doors and more specifically to insulated doors with restorable breakaway sections.

BACKGROUND

Horizontally translating doors usually include one or more door panels that are suspended by carriages or trolleys that travel along an overhead track. To open and close the door, the carriages move the door panels in a generally horizontal direction in front of the doorway. The movement of the panels can be powered or manually operated. Depending on the width of the doorway and the space along either side of it, such doors can assume a variety of configurations. For a relatively narrow doorway with adequate space alongside to receive an opening door panel, a single panel may be sufficient to cover the doorway. Wider doorways with limited side space may require a bi-parting door. Bi-parting doors include at least two panels, each moving in opposite directions from either side of the doorway and meeting at the center of the doorway upon closing.

For even wider doorways or those with even less side space, multi-panel doors can be used. Multi-panel doors have a series of door panels that overlay each other at one side of the doorway when the door is open. When the door closes, each panel slides out from behind the others to cover the span of the doorway. Applying such an arrangement to both sides of the doorway provides a bi-parting door with multiple panels on each side.

Horizontally translating doors are often used for providing access to freezer or cold-storage lockers, which are rooms that provide large-scale refrigerated storage for the food industry. Doorways into such a room are often rather wide to allow forklifts and other material handling equipment to move large quantities of products in and out of the room. When closing off a refrigerated room, horizontally translating doors are often preferred over other types of doors because their panels can be made relatively thick with insulation to reduce the cooling load on the room.

DETAILED DESCRIPTION

Example translating door panel assemblies disclosed herein are relatively rigid and thick with thermal insulation, yet the panels have resilient means for restorably breaking away after an accidental impact. These features make the door panel assemblies particularly suited for commercial freezer and cold storage lockers. In some examples, the panel assembly includes a leading panel and a trailing panel held together by a series of spring loaded cables that extend horizontally through both panels. To prevent damage from an impact, the spring loaded cables allow the leading panel to become restorably dislocated relative to the trailing panel. In some examples, an overhead carriage or trolley solidly connects to and carries the trailing panel while a more flexible vertical joint connects the leading panel to the trailing panel rather than the leading panel connecting to the carriage directly.

FIGS. 1-46 show some example high-speed thermally insulated doors with various example means for restorably breaking away after an accidental impact. Such an impact can be caused by a vehicle or something else striking the door or by the door closing on an obstruction. High speed of translation, thick thermal insulation, relatively ridged construction, and being able to break away make the doors particularly suited for commercial freezer door applications. In some examples, the doors automatically return to normal operation after being dislodged.

Figure 1:
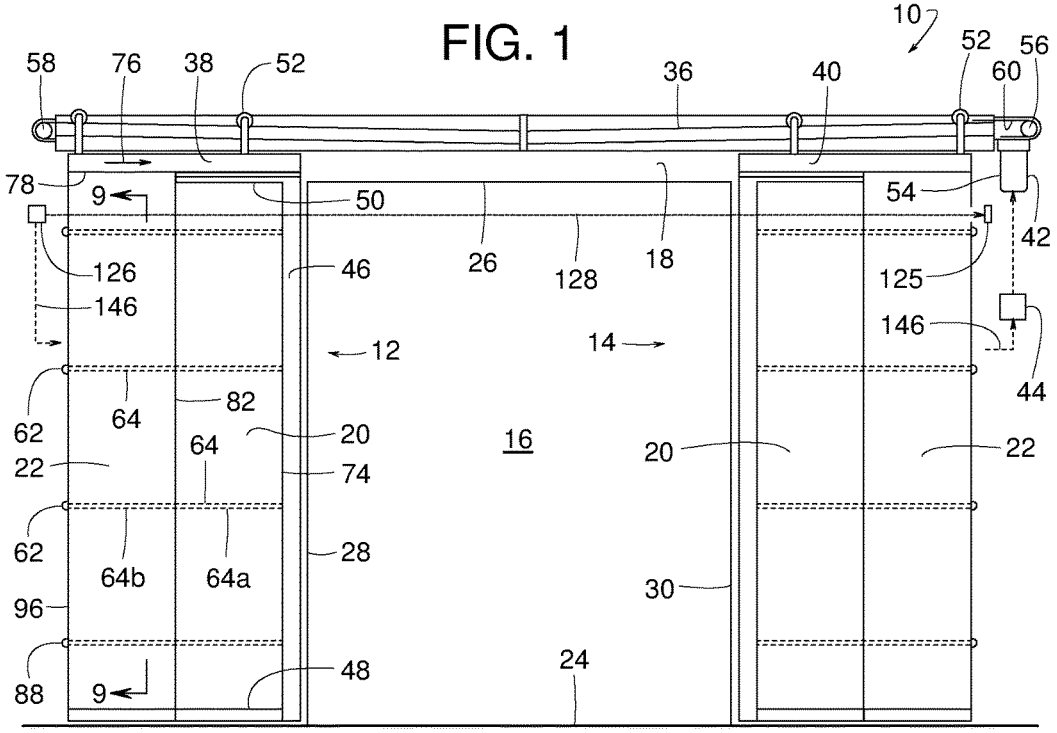
FIG. 1 is a front view of an example door that is open constructed in accordance with the teachings disclosed herein.
Figure 2:
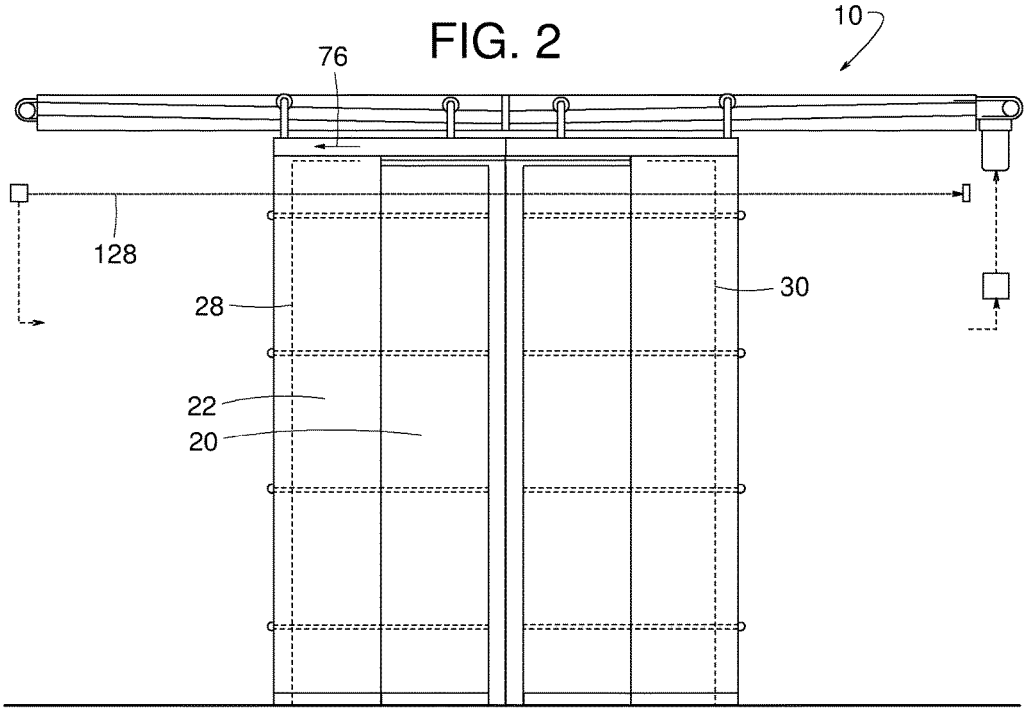
FIG. 2 is a front view similar to FIG. 1 but showing the example door when closed.
Figure 3:
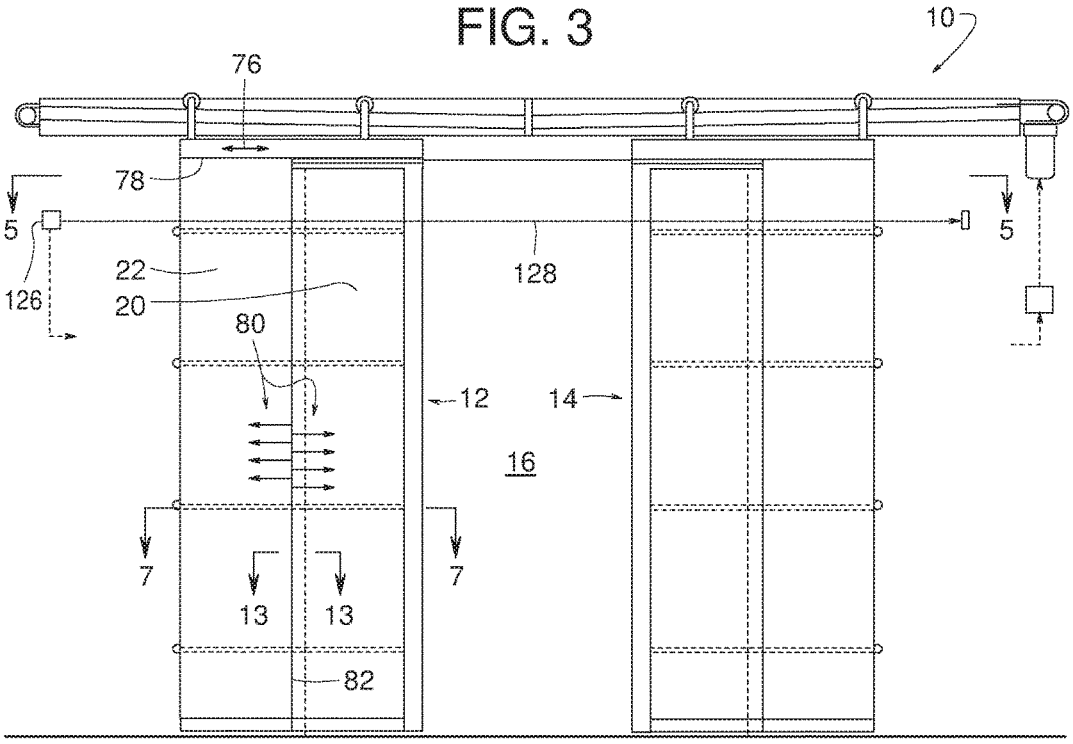
FIG. 3 is a front view similar to FIGS. 1 and 2 but showing the example door in a normal configuration at an intermediate position.
Figure 4:
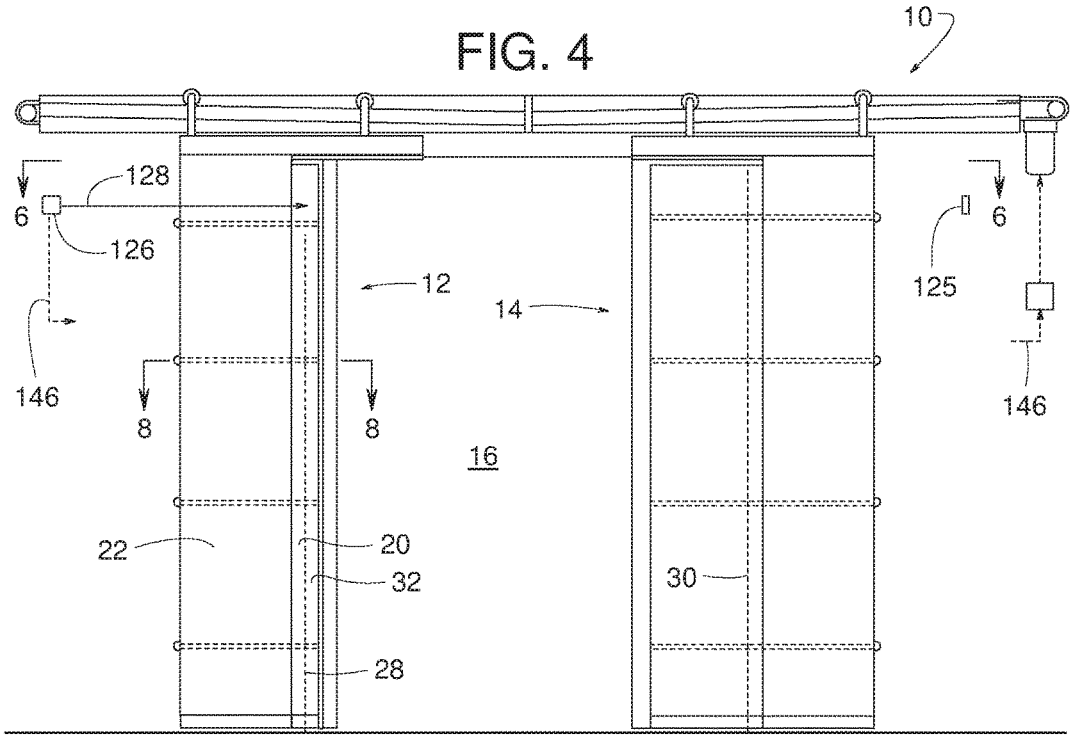
FIG. 4 is a front view similar to FIG. 3 but showing the door in a dislodged configuration at the intermediate position.
Figure 5:
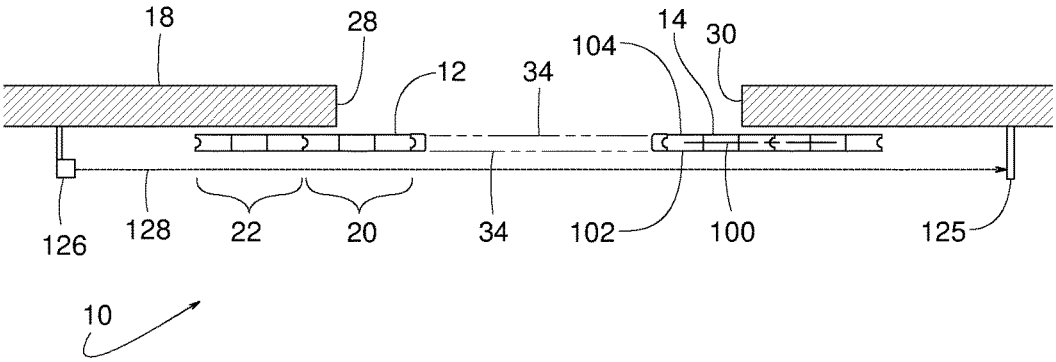
FIG. 5 is a cross-sectional view taken along line 5-5 of FIG. 3.
Figure 6:
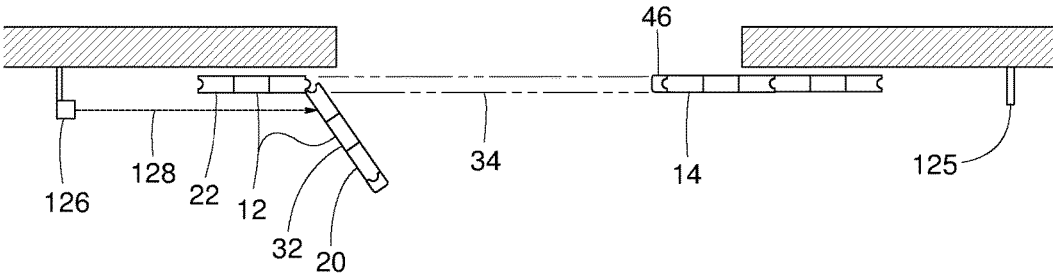
FIG. 6 is a cross-sectional view taken along line 6-6 of FIG. 4.
Figure 7:
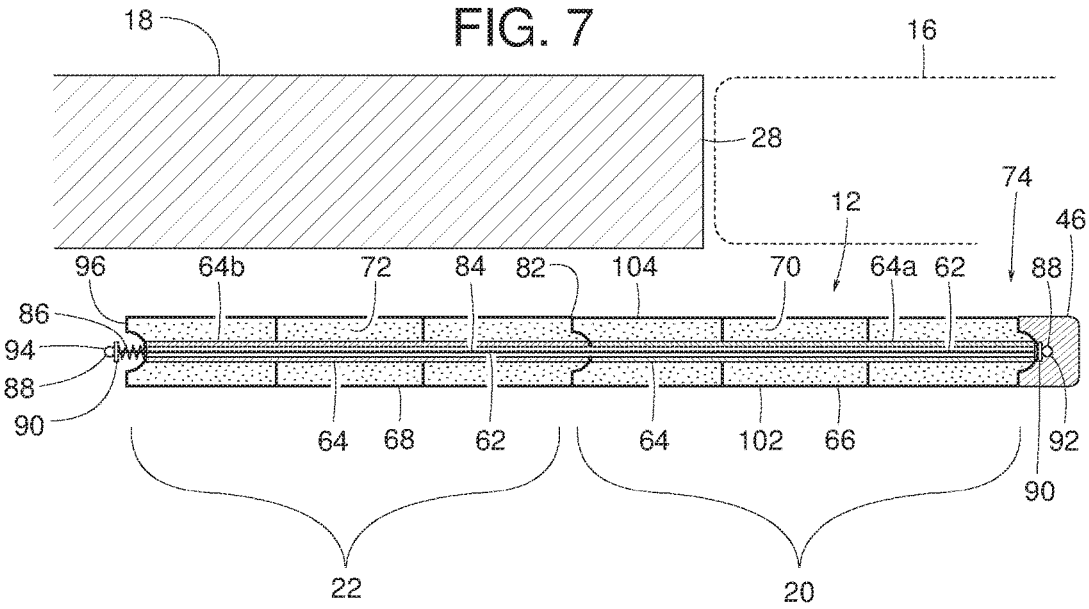
FIG. 7 is a cross-sectional view taken along line 7-7 of FIG. 3.
Figure 8:
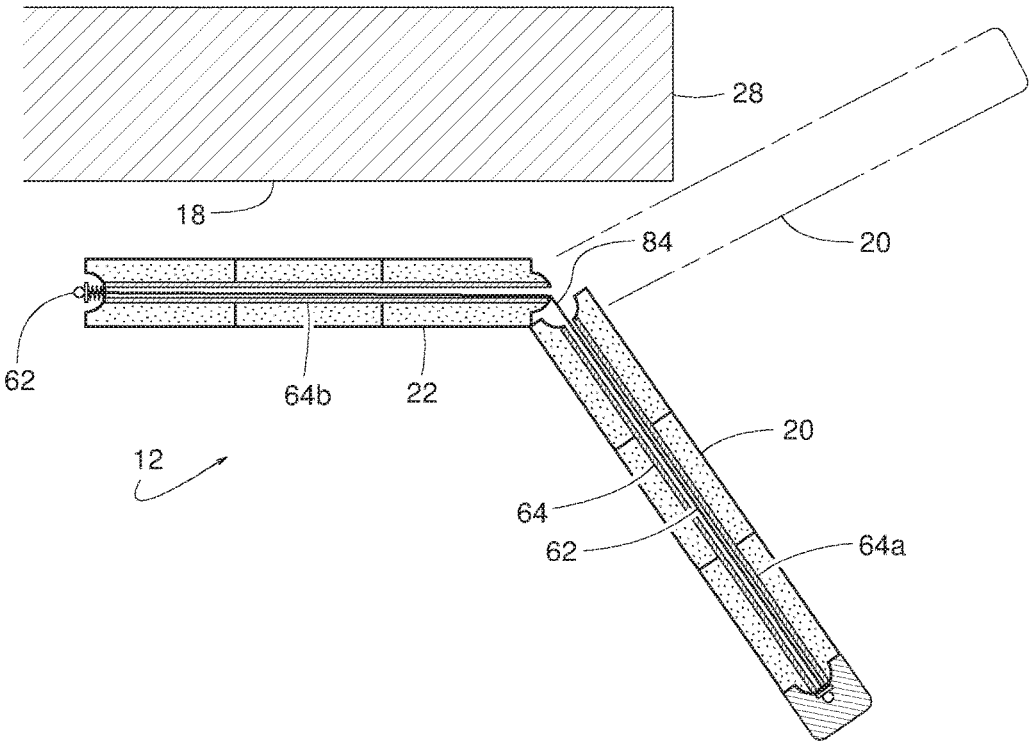
FIG. 8 is a cross-sectional view taken along line 8-8 of FIG. 4.

In the example shown in FIGS. 1-8, a door 10 includes a first panel assembly 12 and a second panel assembly 14 that move in translation together or apart to selectively close or open a doorway 16 of a wall 18. Each of the panel assemblies 12, 14 comprises a leading panel 20 and a trailing panel 22. The doorway 16 extends in a vertical direction between a floor 24 and an upper edge 26 and extends in a horizontal direction between a first lateral edge 28 and a second lateral edge 30. FIG. 1 shows the door 10 open; FIG. 2 shows the door 10 closed; FIGS. 3, 5 and 7 show the door 10 at an intermediate position between the open and closed positions with the panel assemblies 12, 14 being in a normal configuration; and FIGS. 4, 6 and 8 show the door 10 at the intermediate position with the door's first panel assembly 12 in a dislodged configuration.

In some examples, the dislodged configuration is when the leading panel 20 and the trailing panel 22 of a panel assembly 12, 14 are displaced out of coplanar alignment with each other and/or at least a portion 32 of the panel assembly 12, 14 is displaced beyond a normal path 34 of the panel assemblies 12, 14, as shown in FIG. 6. In some examples, the normal configuration is when the leading panel 20 and trailing panel 22 of a panel assembly 12, 14 are in substantially coplanar alignment with each other and/or the panel assembly 12, 14 is entirely within the normal path 34 during normal operation.

In the illustrated example, the door 10 comprises the first panel assembly 12, the second panel assembly 14, an overhead track 36, a first carriage 38, a second carriage 40, a drive unit 42, a controller 44, and various seals. Examples of such seals include a nose seal 46 for sealing along the vertical leading panel edges where the panel assemblies 12, 14 meet when the door 10 is closed, a bottom seal 48 (including two sections corresponding to each of the leading and trailing panels 20, 22) for sealing against the floor 24, an upper seal 50 for sealing along the door's upper edges, and/or various doorway perimeter seals.

In the illustrated example, the track 36 is mounted to the wall 18 above the doorway 16. The carriages 38, 40 include rollers 52 for resting upon and traveling along the track 36. The carriages 38, 40, respectively, suspend panel assemblies 12, 14 from the track 36. The rollers 52 enable the carriages 38, 40 to smoothly carry the panel assemblies 12, 14 in translation between their open and closed positions.

In some examples, the movement of the panel assemblies 12, 14 is powered by the drive unit 42, which comprises a motor 54, a drive wheel 56, an idler wheel 58, and a flexible elongate member 60 (e.g., cable, chain, strap, elastic cord, smooth belt, cogged belt, etc.). In some examples, the elongate member 60 wraps at least partially around the wheels 56, 58 and is driven by the drive wheel 56. The elongate member 60 may connect to the carriages 38, 40 in a suitable manner such that the direction of rotation of the motor 54 and the drive wheel 56 determines whether the panel assemblies 12, 14 move toward each other to close the door 10 or move apart to open the door 10. The controller 44 is schematically illustrated to represent any electronic means for controlling the operating of the drive unit 42 (e.g., controlling the motor's speed, direction of rotation, starting, stopping, accelerating, decelerating, etc.).

In the illustrated examples, the construction of the panel assemblies 12, 14 are basically a mirror image of each other. The first panel assembly 12, in some examples, comprises the leading panel 20, the trailing panel 22, a plurality of tension members 62, a plurality of tubes 64 through which the tension members 62 extend, an outer shell 66 of the leading panel 20, an outer shell 68 of the trailing panel 22, an insulated core 70 of the leading panel 20, an insulated core 72 of the trailing panel 22, the upper seal 50, the bottom seal 48, and the nose seal 46 on a leading edge 74 of the panel assembly 12.

In the illustrated example, the outer shells 66, 68 of the panels 20, 22 are made of a relatively stiff pultruded fiberglass. The stiffness enables the panel assembly 12 to endure high forces of acceleration, so the carriages 38, 40 can rapidly open and close the door 10 without the panel assembly 12 flopping around. Panel stiffness is especially important in examples where the carriage 38 applies most of its horizontal opening/closing driving forces 76 along an upper edge 78 of the trailing panel 22, as shown in FIG. 3. Although stiffness in the leading panel 20 can also be beneficial, in some examples, stiffness is less important for the leading panel 20 because its opening/closing forces 80 are distributed more evenly along a vertical joint 82 between the leading and trailing panels 20, 22. Doors being able to achieve a high speed of operation is particularly important for minimizing thermal losses in freezer applications. In some examples, the outer shells 66, 68 are hollow to reduce the panel's weight, which is important for reducing the forces of acceleration in high-speed door operation. In some such examples, the insulated cores 70, 72, having a higher R-value than that of the outer shells 66, 68, fill the hollow interiors of the panels 20, 22 to reduce heat transfer through the panel assembly 12. Example materials of the cores 70, 72 include polyurethane foam, polystyrene foam, cellulose, mineral wool, and fiberglass wool.

In some examples, the tension members 62 are in resilient horizontal tension, which forces the leading panel 20 and the trailing panel 22 toward each other. In some examples, the tension members 62 clamp the panels 20, 22 together in horizontal compression and provide the resulting panel assembly 12 with the flexibility to restorably break away in response to an impact. In some examples, the force of the tension members 62 is the only force used to clamp or hold the edge of the leading panel 20 in place against the edge of the trailing panel 22. That is, in some examples, but for the tension members 62, the leading panel 20 is completely separable from the trailing panel 22, the carriage 38, and the rest the panel assembly 12 when in operation. In other words, in some examples, the leading panel 20 is not hinged to or otherwise directly connected or rigidly fastened to the trailing panel 22 or the carriage 38 via any mechanism other than the tension members 62. As a result, in some such examples, the force to cause the leading panel to move from the closed position to the open position is transmitted exclusively through the tension members 62. Furthermore, in some examples, the force on the leading panel 20 produced by the tension members 62 is the sole force causing the leading panel 20 to be held in substantially coplanar alignment with the trailing panel 22 during normal operation. That is, in some examples, the top edge, the bottom, and the leading edge 74 of leading panel 20 are disconnected from adjacent components of the door 10. Of course, in some examples, the edges of the leading panel 20 may nevertheless abut or rub against adjacent components (e.g., the carriage 38 above or the floor 24 below). However, in some examples, the leading panel 20 is not structurally inhibited from movement out of coplanar alignment with the trailing panel 22 along the top, bottom, or leading edge of the leading panel 20. Stated more generally, in some examples, the leading panel 20 may come into contact but remain structurally decoupled from surrounding components except along the edge of the leading panel 12 along the vertical joint 82 between the leading and trailing panel 12. As used herein, an object is structurally decoupled from an adjacent component when the object, though possibly in contact with a surface of the component, is not mechanically inhibited from moving (i.e., is free to move) along the surface of the adjacent component.

In the examples illustrated in FIGS. 1-21, 33, and 39-41, each tension member 62 comprises a flexible steel cable 84, a compression spring 86, two cable stops 88, and two washers 90. In some examples, each of the tension members 62 includes a strap. In some examples, each of the tension members 62 includes an elastic cord. A plurality of tubes 64 (e.g., a leading tube **64*a* in the leading panel 20 and a trailing tube 64*b* in the trailing panel 22) make it easier to feed the cable 84 through the panels 20, 22 during initial assembly or subsequent maintenance. As shown in FIG. 7, the leading tube 64*a* and the trailing tube 64*b* are substantially collinear with each other when the panel assembly 12 is in the normal configuration. In the illustrated example, a leading end 92 of the tension member 62 is proximate the leading edge 74 of the leading panel 20, and a trailing end 94 of the tension member 62 is proximate a trailing edge 96 of the trailing panel 22**.

In some examples, the spring 86 being in compression holds the cable 84 in tension between the stops 88. The washers 90 prevent the spring 86 from being drawn into the tube **64*b*, prevent the stop 88 from being drawn into the inner diameter of the spring 86, and prevent the stop 88 near the nose seal 46 from being drawn into the tube 64*a*. In some examples, resilient tension in the member 62 is achieved by the member 62 itself being elastic. In other examples, a tension spring is incorporated somewhere along the length of the tension member 62**.

In some examples, the tension member 62 allows the panel assembly 12 to resiliently yield to an impact by deflecting from a normal configuration (FIG. 7) to a dislodged configuration (FIG. 8). In the dislodged configuration, increased compression in the spring 86 and/or tension in the cable 84 urges the panel assembly 12 back to its normal configuration. In some examples, the joint 82 is a tongue-and-groove joint that helps realign the leading panel 20 and the trailing panel 22, as the panel assembly 12 returns to its normal configuration. In FIG. 8, the leading panel 20 shown in solid lines represents the panel assembly 12 in the dislodged configuration in a first displaced arrangement, and the leading panel 20 shown in phantom lines represents the panel assembly 12 in the dislodged configuration in a second displaced arrangement. FIG. 8 also shows the tension member 62 being more flexible than the panels 20, 22, which enables a relatively stiff panel assembly to resiliently break away in response to an impact.

Figure 9:
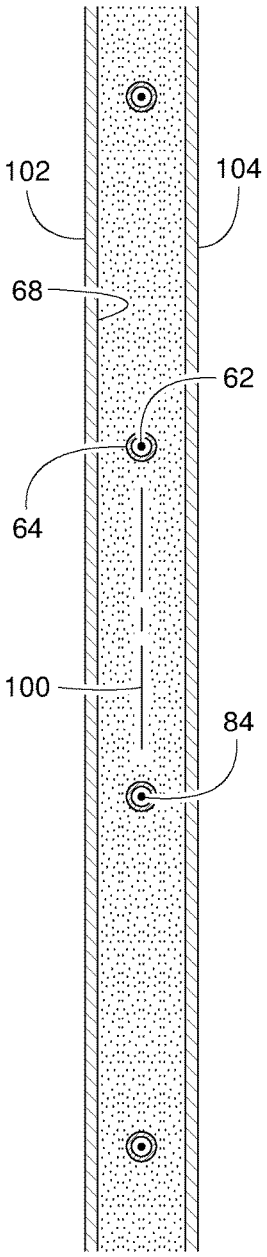
FIG. 9 is a cross-sectional view taken along line 9-9 of FIG. 1.
Figure 10:
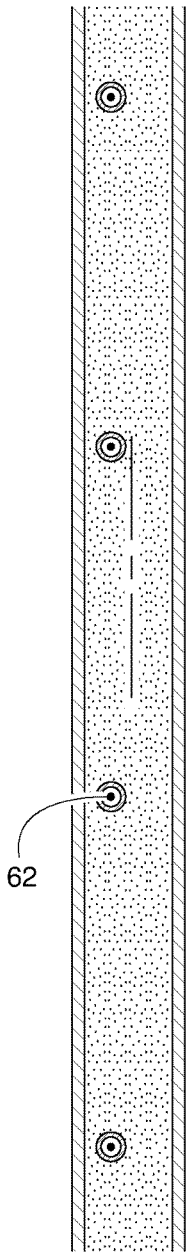
FIG. 10 is a cross-sectional view similar to FIG. 9 but showing another example door constructed in accordance with the teachings disclosed herein.
Figure 11:
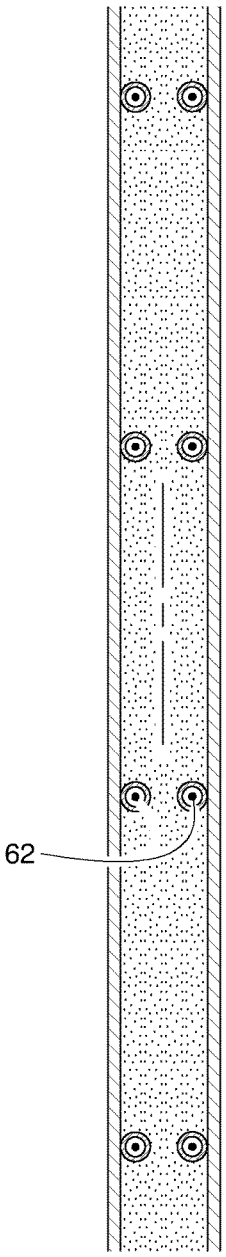
FIG. 11 is a cross-sectional view similar to FIG. 9 but showing another example door constructed in accordance with the teachings disclosed herein.
Figure 12:
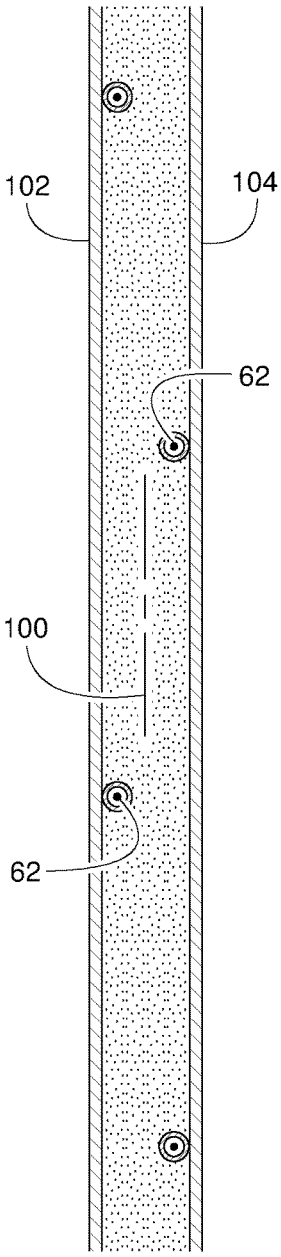
FIG. 12 is a cross-sectional view similar to FIG. 9 but showing another example door constructed in accordance with the teachings disclosed herein.

The arrangement of the tension members 62 in the panel assembly 12 may be altered to achieve various beneficial results. In the example arrangement shown in FIG. 9, a single column of the tension members 62 are centrally located on a neutral plane 100 between a front face 102 and a back face 104 of the panel assembly 12. This results in the leading panel 20 being able to readily deflect in either direction, towards and away from the doorway 16. In the example arrangement of FIG. 10, the tension members 62 are biased toward either the front face 102 or the back face 104, which enables leading panel 20 to deflect in one direction easier than the other. This might be a benefit in some installations. FIG. 11 shows two columns of tension members 62, which provide greater restorative forces for a given tensile force in the members 62. FIG. 12 shows an example arrangement providing a benefit similar to that of FIG. 11 but using the same number of the tension members 62 as shown in FIGS. 9 and 10.

Figure 13:
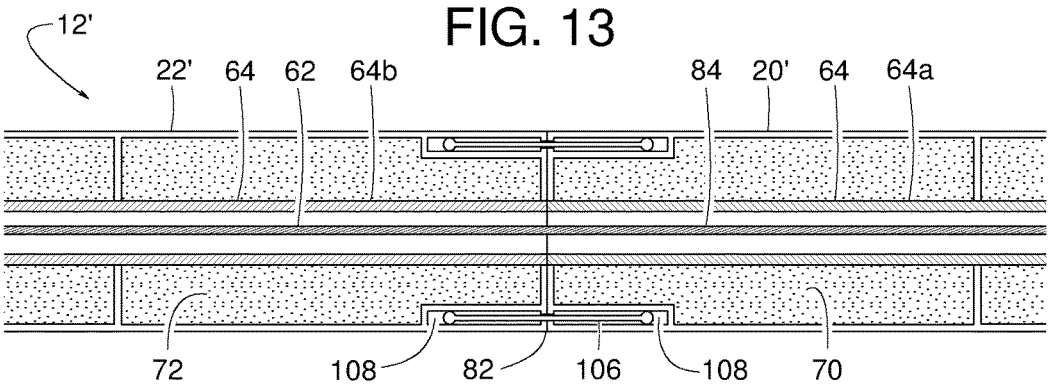
FIG. 13 is a cross-sectional view similar to one taken along line 13-13 of FIG. 3 but showing a different example panel joint constructed in accordance with the teachings disclosed herein.
Figure 14:
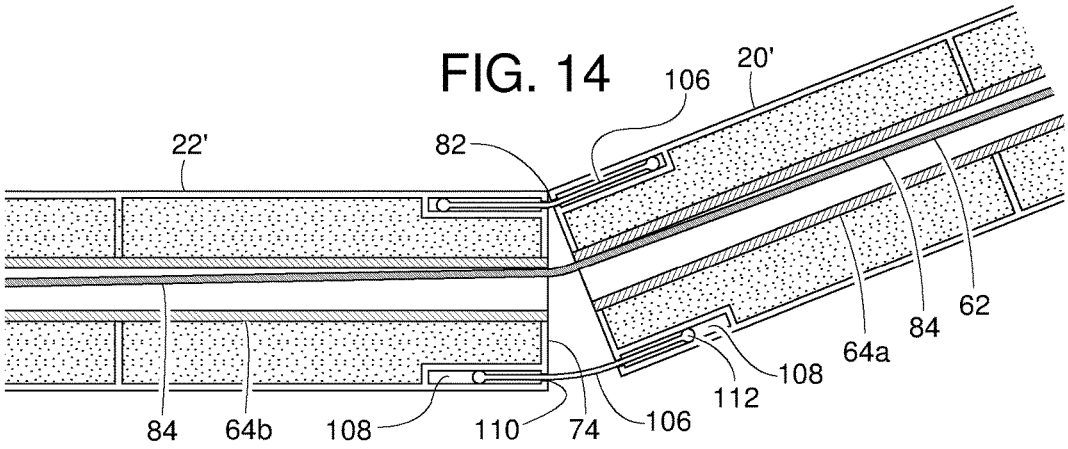
FIG. 14 is a cross-sectional view similar to FIG. 13 but showing the example joint in a dislodged configuration.
Figure 15:
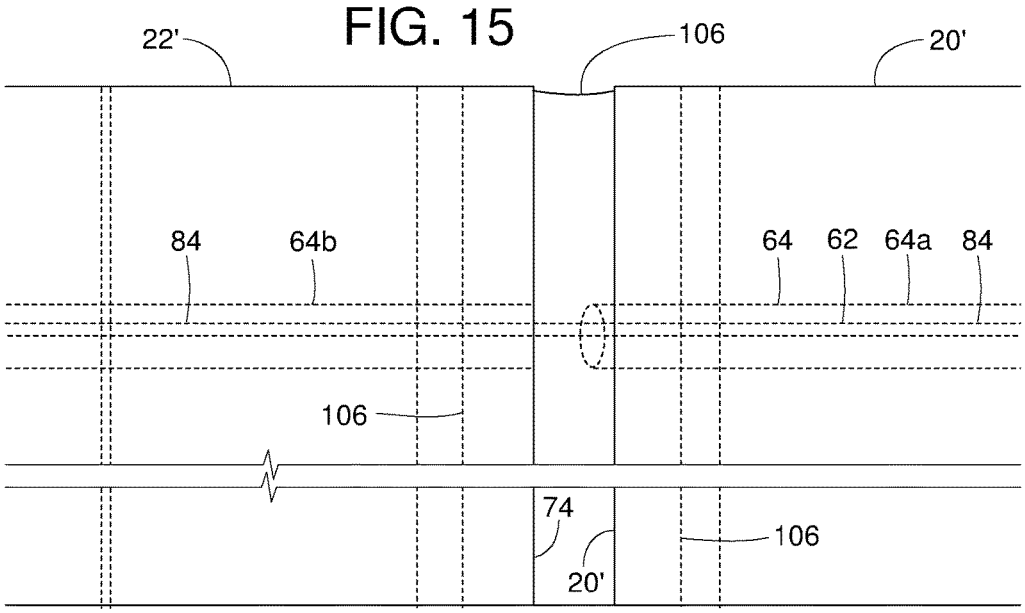
FIG. 15 is a front view of FIG. 14.
Figure 16:
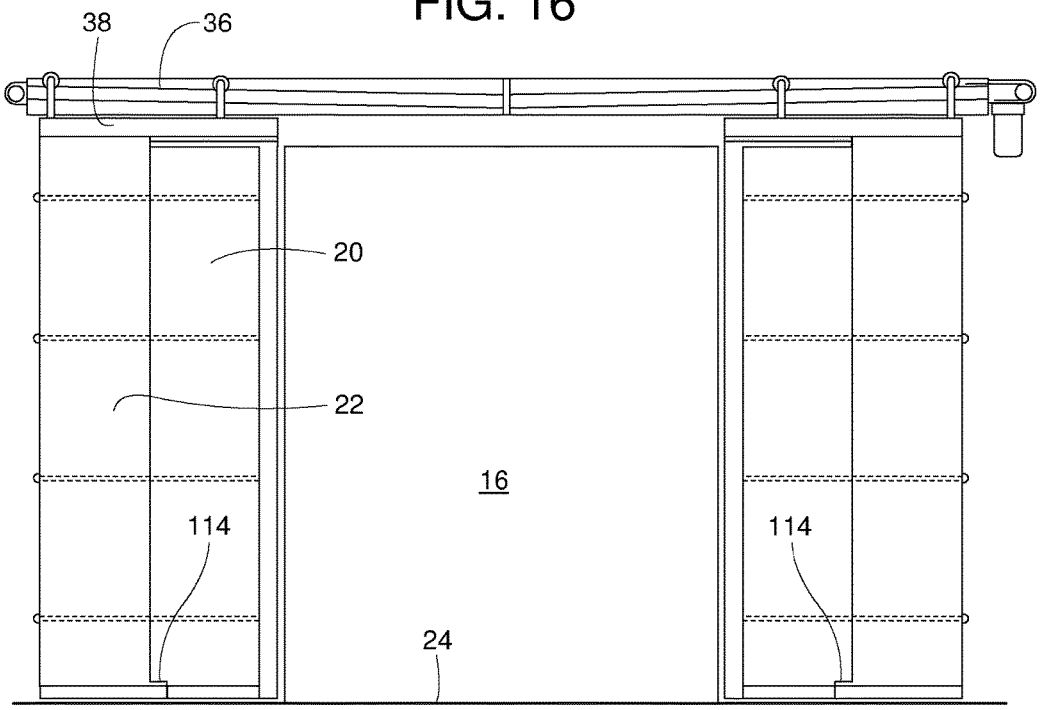
FIG. 16 is a front view similar to FIG. 1 but showing another example door that is open constructed in accordance with the teachings disclosed herein.
Figure 17:
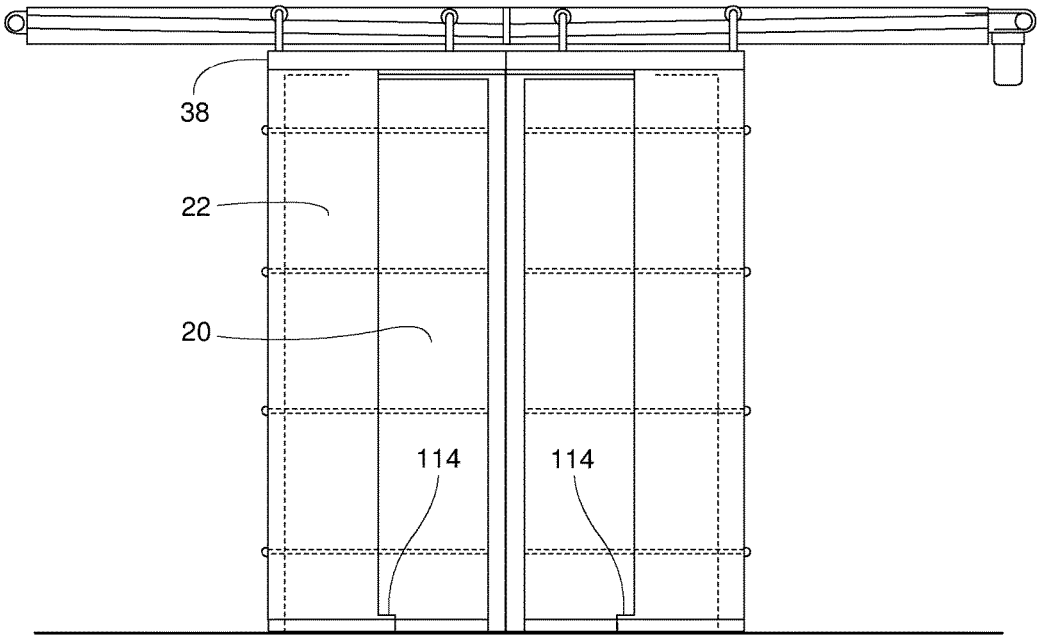
FIG. 17 is a front view similar to FIG. 16 but showing the example door when closed.

To avoid creating a finger pinch point at the vertical joint 82 between a leading panel 20' and a trailing panel 22', some examples of the joint 82 are as shown in FIGS. 13-15, wherein the panels 20', 22' are nearly identical to the panels 20, 22, respectively. In this example, a shield 106 extending substantially the full vertical length of the panels 20', 22' overlies the joint 82. In the illustrated example, the shield 106 fits within integral channels 108 of the panels 20', 22'. A sliding fit between the shield 106 and the channel 108 allows the shield 106 to slide horizontally within the channel 108 as the panel assembly 12' pivots between its normal configuration (FIG. 13) and its dislodged configuration (FIGS. 14 and 15). In some examples, to hold the shield 106 within the channel 108, a restricted inlet 110 of the channel 108 helps contain an enlarged bead 112 running along the vertical edges of the shield 106. In other examples, the shield 106 is flat with no such beads. In some examples, shield 106 is a polypropylene extrusion with a web material thickness of about 45 mils. Other example shield materials include metal, rubber, fabric, nylon and other polymers.

In some examples, the force produced from the tension members 62 pulling the leading panel 20 against the trailing panel 22 serves to support the weight of the leading panel 20. That is, in some examples, the leading panel 20 is unsupported at a top edge of the leading panel 20. In some examples, the tension members 62 may extend at an angle with the trailing end 94 being higher than the leading end 92 such that the tensile forces in the tension members 62 include a vertical component to further help support the weight of the trailing panel 22. Additionally or alternatively, in the example shown in FIGS. 16 and 17, a support member 114 extends rigidly and in a cantilevered manner from the trailing panel 22 to help carry the weight of the leading panel 20. In some examples, the support member 114 extends out from the trailing panel 22 approximately 0.5 inches. However, other examples may have larger or smaller support members 114 as needed (e.g., 1 inch, 2 inches, etc.). In some examples, the bottom seal 48 includes a notch to provide space for the support member 114. In the illustrated example, the support member 114 is proximate the floor 24; however, other examples may have the support member 114 at a higher elevation. Furthermore, in some examples, there may be multiple support members 114 spaced at various heights along the vertical joint 82. In any case, the trailing panel 22 carries most or substantially all of weight of the leading panel 20, and the carriage 38 carries most or substantially all of the weight of the trailing panel 22. Thus, the trailing panel 22 transmits the weight of the leading panel 20 to the carriage 38. This arrangement allows the leading panel 20 to readily break away under impact. In some examples, upon deflecting from the normal configuration to the dislodged configuration, the leading panel 20 pivots on the support member 114. In some examples, the top surface of the support member 114 is generally flat such that the leading panel 20 is free to move on the surface of the support member 114. In some such examples, the leading panel 20 is held on the support member 114 by virtue of the force of the tension members 62 urging the leading panel 20 towards the trailing panel 22. That is, the leading panel 20 may remain structurally decoupled from the support member 114 such that the pivoting is accomplished without a structurally limiting hinge, pin, joint, or other structurally defined rotational guide connecting the leading panel 20 to the support member 114. In other examples, the leading panel 20 and the support member 114 may include a rotational guide.

Figure 18:
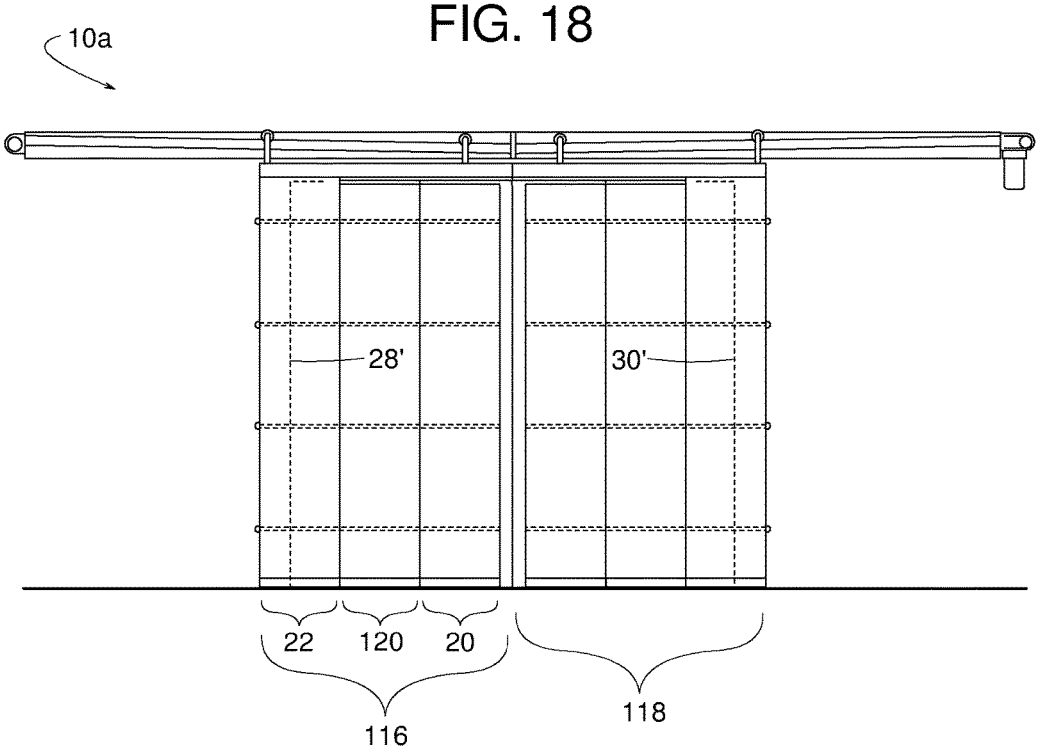
FIG. 18 is a front view similar to FIGS. 2 and 17 but showing another example door that is closed constructed in accordance with the teachings disclosed herein.
Figure 19:
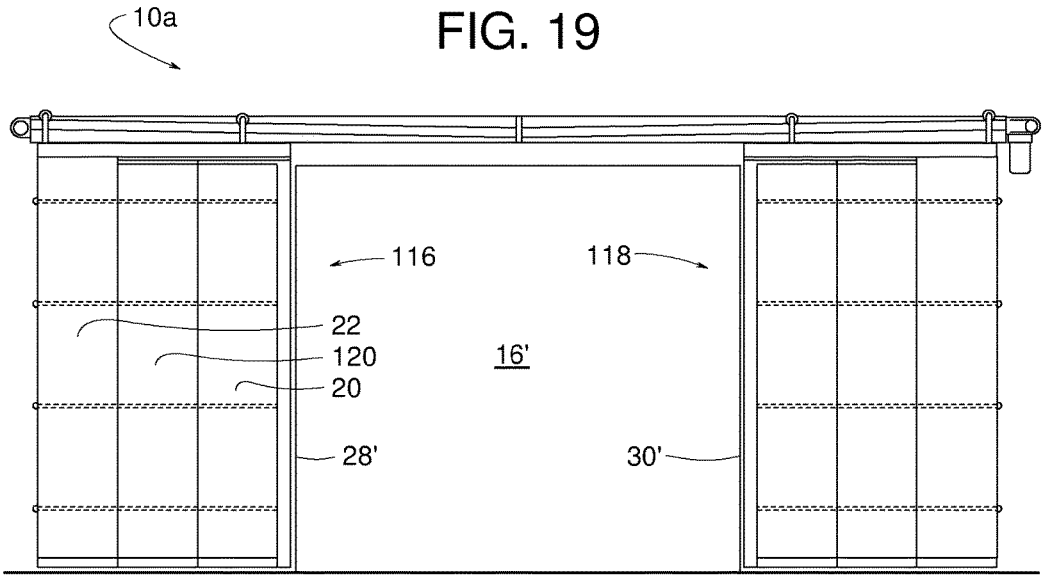
FIG. 19 is a front view similar to FIG. 18 but showing the example door when open.
Figure 20:
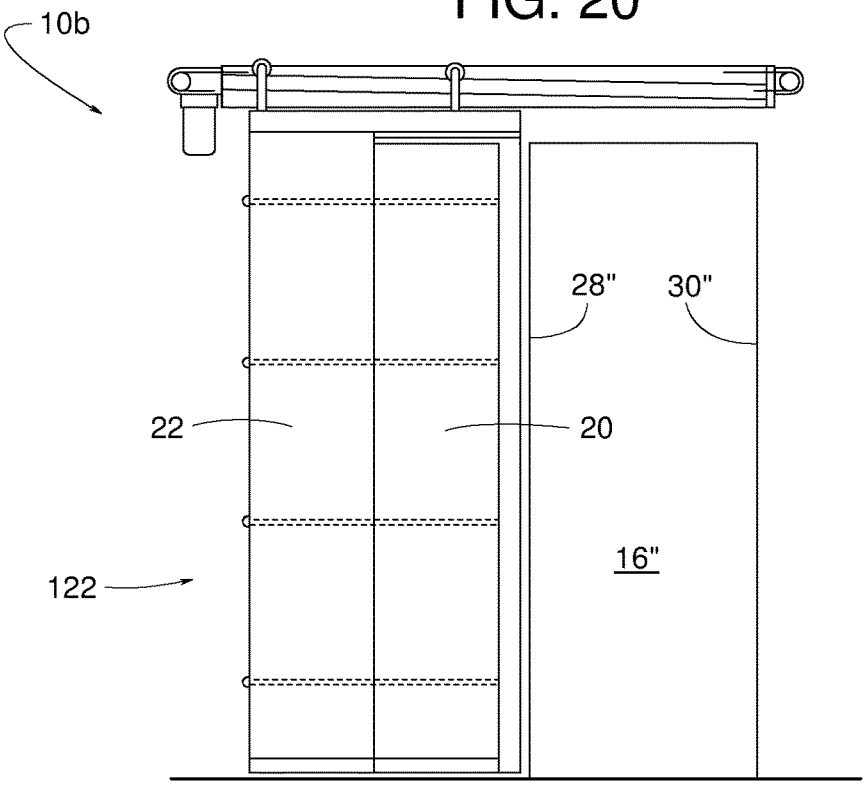
FIG. 20 is a front view similar to FIGS. 1, 16, and 19 but showing another example door that is open constructed in accordance with the teachings disclosed herein.
Figure 21:
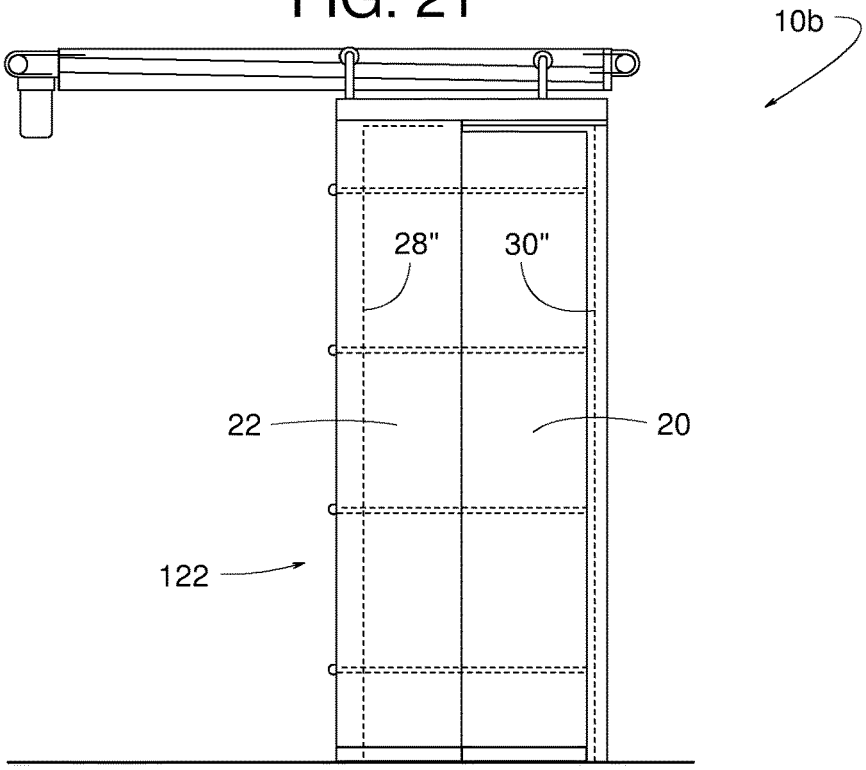
FIG. 21 is a front view similar to FIG. 20 but showing the example door when closed.

Although FIGS. 1-3 show the door 10 having two panel assemblies 12, 14 each comprising two panels (e.g., panels 20, 22), the door 10 can have other numbers of panel assemblies and panels. FIGS. 18 and 19, for example, show an example door 10*a* having two panel assemblies 116, 118 each comprising three panels (i.e., an intermediate panel 120 between the leading panel 20 and the trailing panel 22). In some examples, the intermediate panel 120 is similar in construction to the adjacent leading and trailing panels 20, 22. FIG. 18 shows the door 10*a* closed, and FIG. 19 shows the door 10*a* open relative to a particularly wide doorway 16' with two lateral edges 28', 30'. FIGS. 20 and 21 show an example door 10*b* having just one panel assembly 122 comprising the two panels 20, 22. FIG. 20 shows the door 10*b* open, and FIG. 21 shows the door 10*b* closed relative to a narrow doorway 16" with two lateral edges 28", 30".

Figure 22:
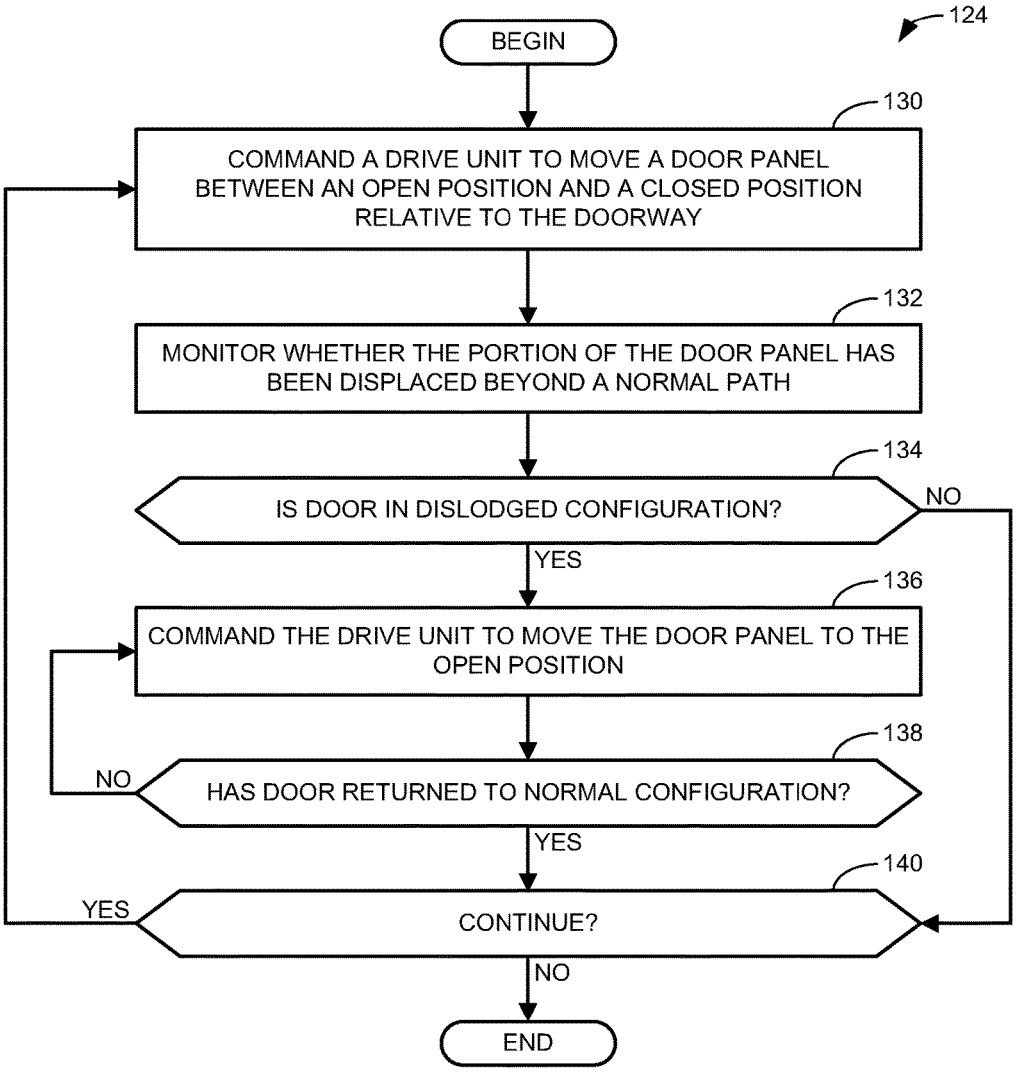
FIG. 22 is a block diagram illustrating an example door method performed in accordance with the teachings disclosed herein.

In some examples, in response to an impact, the door's configuration is sensed, and the door 10 (or the doors 10', 10") is controlled to automatically and slowly return to its open position and/or return to its normal configuration. FIG. 22, for instance, is a flowchart describing an example door method 124 involving the use of an electronic sensor 126. The electronic sensor 126 is schematically illustrated (in FIGS. 1-6) to represent any optical device capable of sensing whether at least a portion of a door panel has been displaced beyond its normal path of travel. Examples of the electronic sensor 126 include a device emitting and/or receiving a light beam 128 (e.g., a laser), and a camera with video analytics. In some examples, the electronic sensor 126 is associated with a reflector 125.

In the example door method 124, shown in FIG. 22, block 130 represents the controller 44 commanding the drive unit 42 to move a door panel between an open position and a closed position relative to the doorway 16. When in a normal configuration, a portion of the door panel translates along the normal path 34 in front of the doorway 16 as the door panel moves between the open position and the closed position. Block 132 represents the electronic sensor 126 monitoring (e.g., optically sensing) whether the portion of the door panel has been displaced beyond the normal path 34. In some examples, the portion of the door panel being displaced beyond the normal path 34 (e.g., due to an impact), is indicative of the door panel changing from a normal configuration where the portion of the door panel is within the normal path 34 to a dislodged configuration. Block 134 represents the controller determining whether the door panel is in a dislodged configuration. In some examples, this determination is made based on the electronic sensor 126 providing the controller 44 a feedback signal 146 in response to sensing the portion of the door panel moving beyond the normal path 34. If the controller 44 determines that the door panel is in a dislodged configuration, control advances to block 136 where the controller 44 commands the drive unit 42 to move the door panel to the open position. In some examples, the door is opened at a slower speed when in the dislodged configuration than the speed of the door when in the normal configuration. In some such examples, the reduced second speed provides an opportunity for the door panel to be restored to the normal configuration as the tension members 62 force the leading and trailing panels 20, 22 back into alignment. Block 138 represents the controller 44 determining whether the door panel has been returned to the normal configuration (e.g., based on feedback from the electronic sensor 126 indicating the door panel is no longer displaced beyond the normal path 34). If the door has not yet returned to the normal configuration, control returns to block 136. If the controller determines that the door has returned to the normal configuration, control advances to block 140, which represents the controller determining whether to continue controlling the drive unit 42. If so, control returns to block 130; otherwise, the example method of FIG. 22 ends. Returning to block 134, if the controller 44 determines that the door panel is not in a dislodged configuration, control advances directly to block 140.

Figure 23:
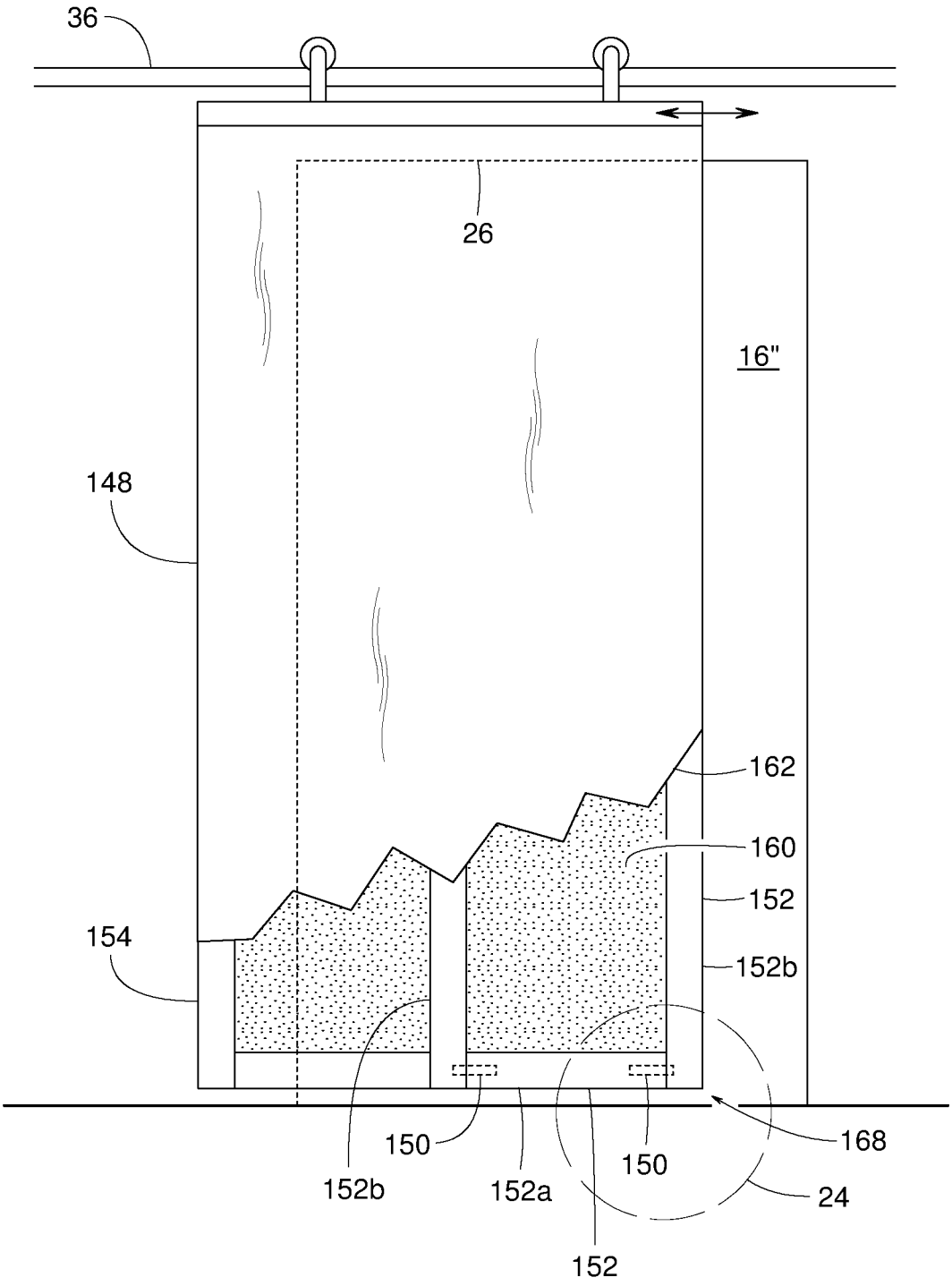
FIG. 23 is a cut-away front view of another example door constructed in accordance with the teachings disclosed herein.
Figure 24:
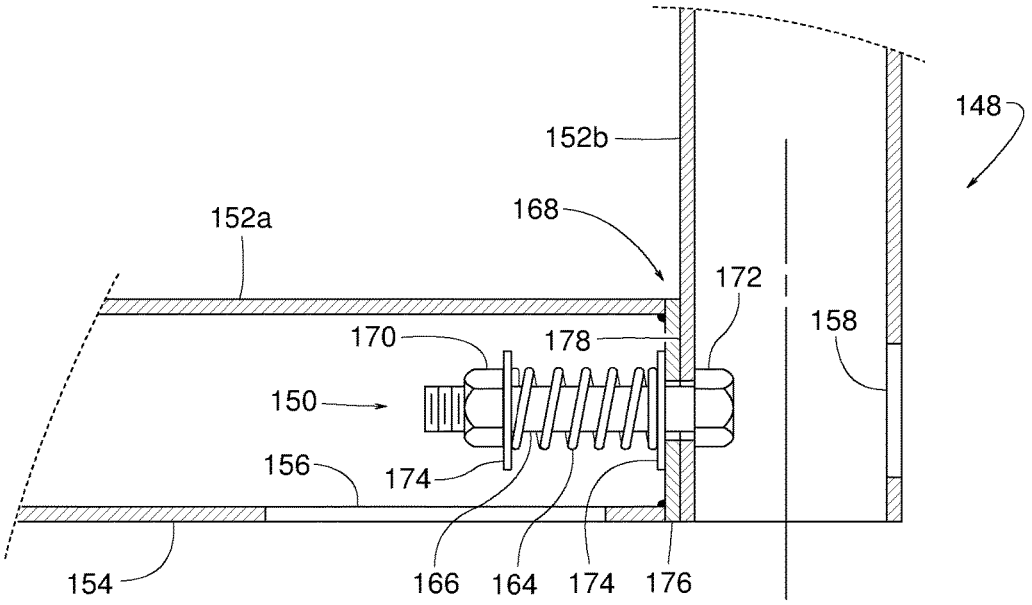
FIG. 24 is an enlarged cross-sectional view of the area shown within circle-24 of FIG. 23.
Figure 25:
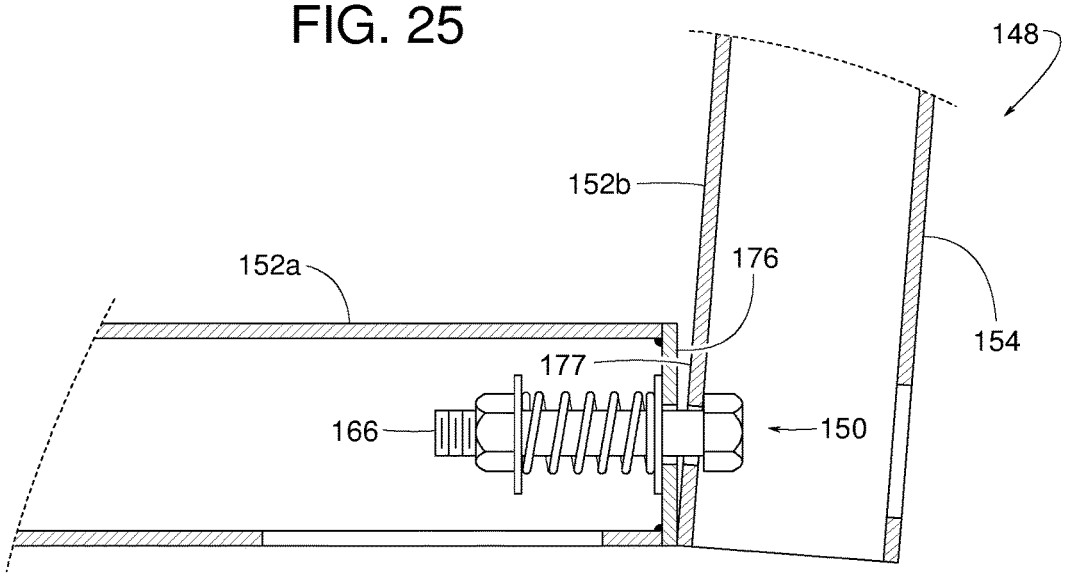
FIG. 25 is an enlarged cross-sectional view similar to FIG. 24 but showing the example door panel in a dislodged configuration.

In the example shown in FIGS. 23-25, a panel assembly 148 can be restorably broken away by virtue of a spring loaded connector 150 that resiliently fastens a first generally horizontal frame member 152*a* to a second generally vertical frame member 152*b*. FIGS. 23 and 24 show the spring loaded connector 150 holding the panel assembly 148 in a normal configuration, and FIG. 25 shows the connector 150 resiliently yielding to the panel assembly 148 having shifted to a dislodged configuration, wherein the panel assembly 148 is more planar and/or more rectangular in the normal configuration than in the dislodged configuration. Although FIG. 25 illustrates the vertical frame member 152*b* displaced relative to the horizontal frame member 152*a* in the plane of the door panel, the dislodged configuration includes displacement of the frame members 152*a*, 152*b* in any direction.

In this example, the overhead track 36 suspends the panel assembly 148 across the doorway 16". In some examples, the panel assembly comprises a frame assembly 154 comprising a plurality of frame members 152 (e.g., the frame members 152*a*, 152*b* mentioned above). In some examples, the frame members 152 are square or rectangular tubes. Example materials of the frame members 152 include an extruded polymer, an extruded aluminum, and pultruded fiberglass. Some examples of the frame members 152 have openings 156, 158 for installing and/or accessing the spring loaded connector 150. In some examples, an interior surrounded by the tubular frame members 152 contains an insulated core 160 similar in construction to that of the cores 70, 72. For the protection of the core 160 and for appearance, examples of the panel assembly 148 have a covering 162 overlying the frame members 152 and the insulated core 160. In some examples, the covering 162 is a flexible or pliable sheet of material. To accommodate relative movement between the frame members 152*a*, 152*b* (e.g., when dislodged from one another), some examples of the covering 162 are more flexible than the frame members 152*a*, 152*b*. In some examples, the insulated core 160 has a higher R-value than that of the frame members 152 and the covering 162.

Although the actual construction of the spring loaded connector 150 may vary, the illustrated example of the connector 150 comprises a helical compression spring 164 encircling a threaded fastener 166 that connects the frame members 152*a*, 152*b* at a corner 168 of the panel assembly 148. A nut 170 and a head 172 of the fastener 166 holds the spring 164 in compression between two washers 174. As shown in the illustrated example, the spring 164 clamps an end plate 176 of the frame member 152*a* to a sidewall 177 of the frame member 152*b*. Although the spring clamping force is tight, the compressibility of the spring 164 allows the frame members 152*a*, 152*b* to resiliently shift or tilt relative to each other in a yielding yet restorable manner in response to an impact forcing them to do so. When the panel assembly 148 is in the dislodged configuration, the spring loaded connector 150 urges the panel assembly 148 back toward the normal configuration.

Figure 26:
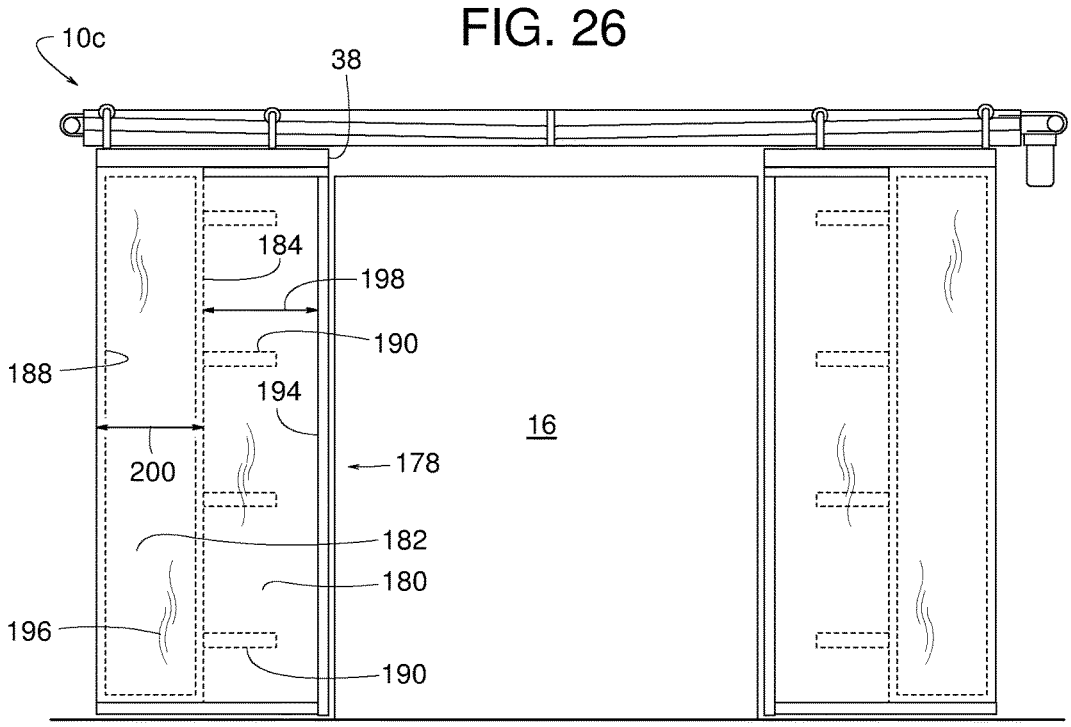
FIG. 26 is a front view similar to FIGS. 1, 16, 19 and 20 but showing another example door that is open constructed in accordance with the teachings disclosed herein.
Figure 27:
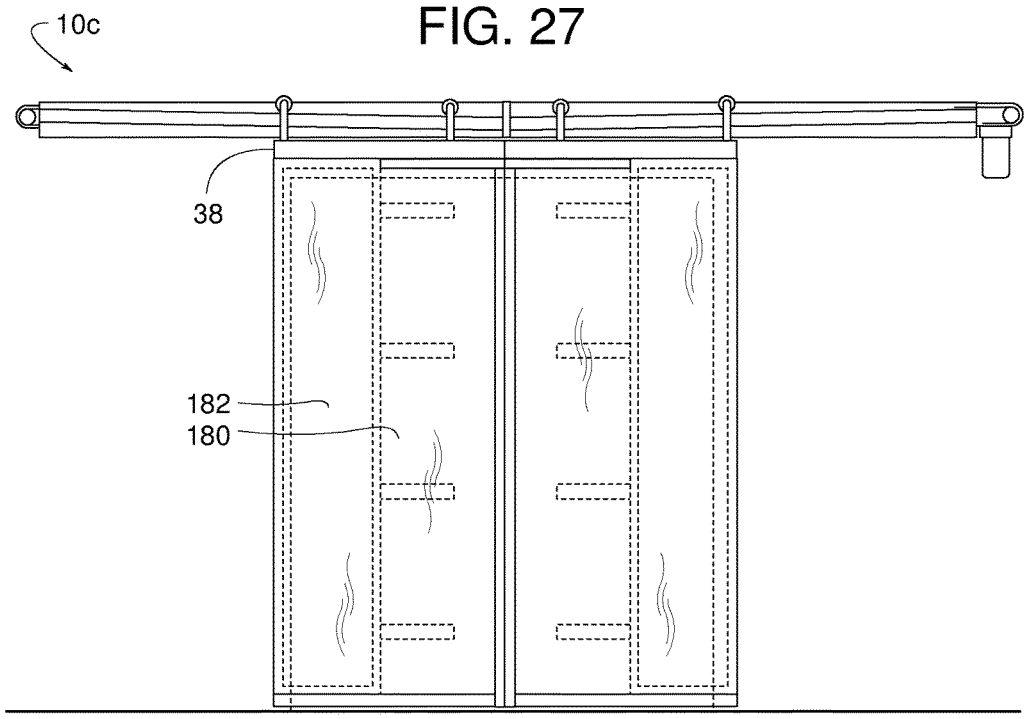
FIG. 27 is a front view similar to FIG. 26 but showing the example door when closed.
Figure 28:
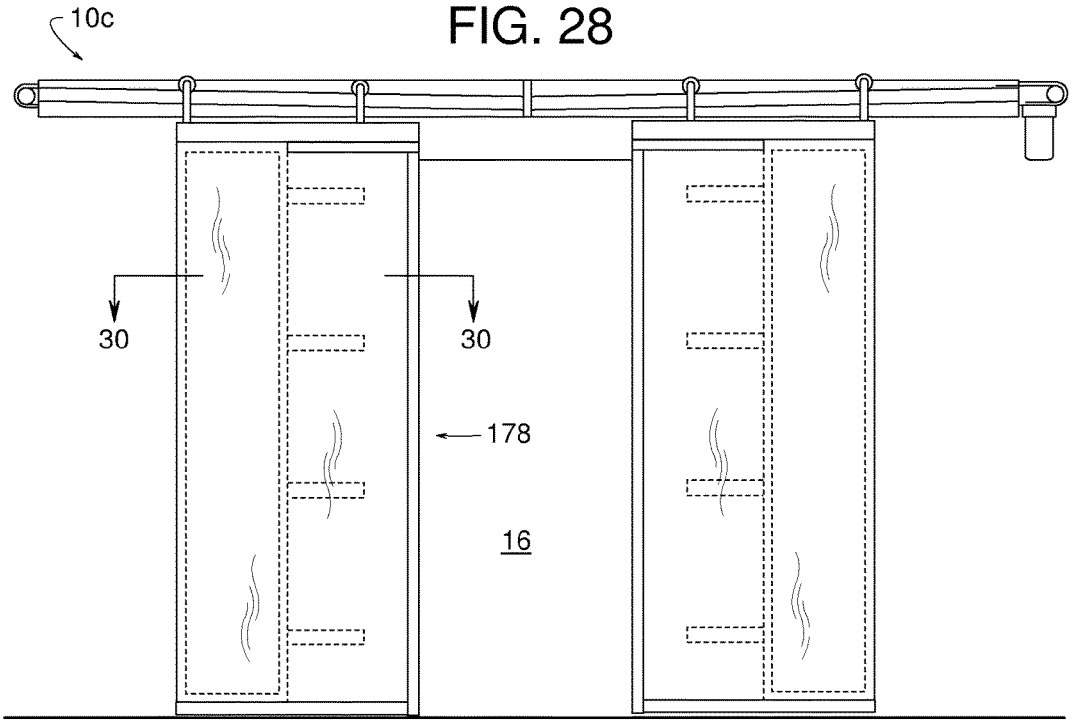
FIG. 28 is a front view similar to FIG. 26 but showing the example door in a normal configuration at an intermediate position.
Figure 29:
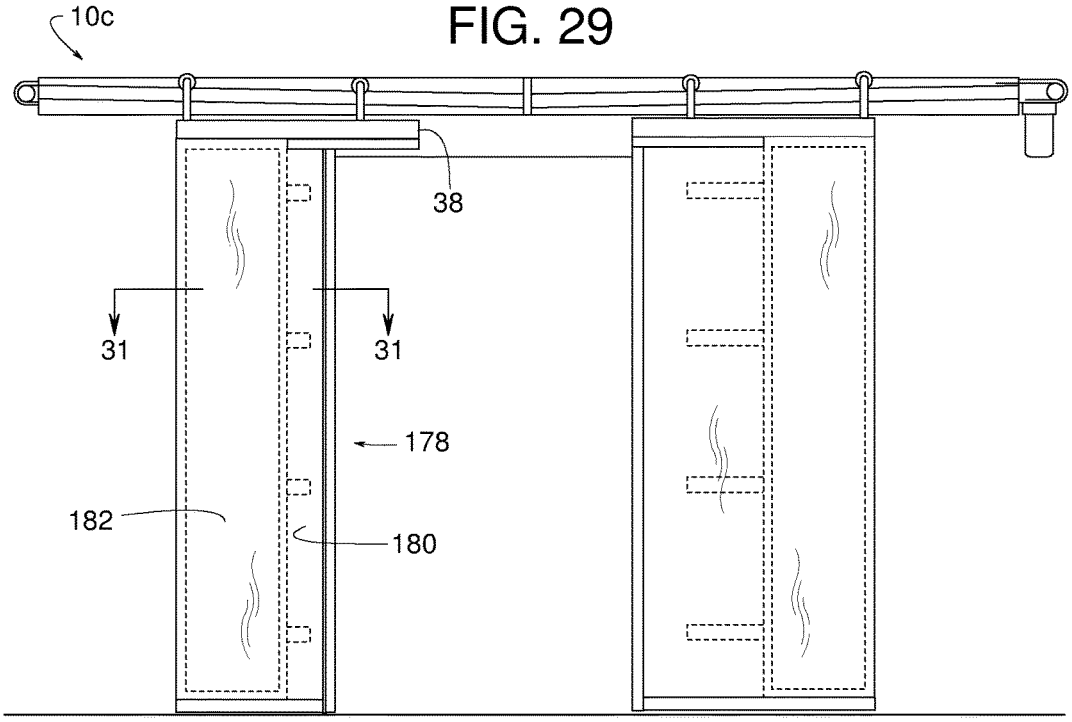
FIG. 29 is a front view similar to FIG. 28 but showing the example door in a dislodged configuration at the intermediate position.
Figure 30:
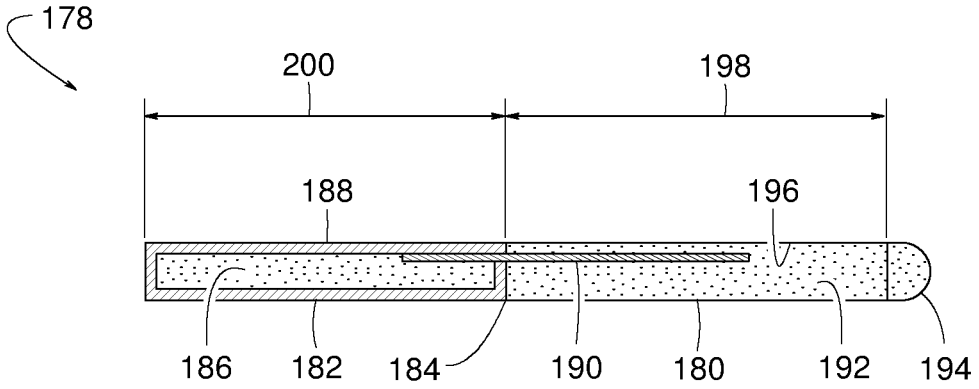
FIG. 30 is a cross-sectional view taken along line 30-30 of FIG. 28.
Figure 31:
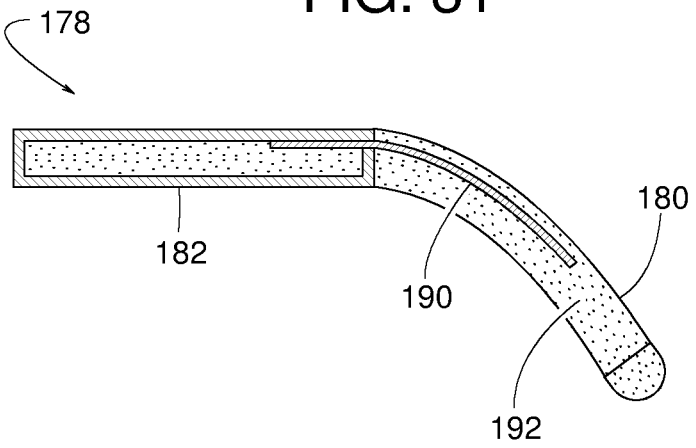
FIG. 31 is a cross-sectional view taken along line 31-31 of FIG. 29.

In addition or alternatively, an example door 10*c*, shown in FIGS. 26-31, includes a panel assembly 178 comprising a leading section 180 that is a deformable extension of a more rigid trailing section 182. In some examples, the sections 180, 182 are joined to each other along a vertically elongate interface 184 between the sections 180, 182. In some examples, the trailing section 182 carries the weight of leading section 180, and the carriage 38 carries the weight of the trailing section 182, thus the trailing section 182 transmits the weight of the leading section 180 to the carriage 38. FIG. 26 shows the panel assembly 178 in a normal configuration at an open position, FIG. 27 shows the panel assembly 178 in a normal configuration at a closed position, FIGS. 28 and 30 show the panel assembly 178 in a normal configuration at an intermediate position, and FIGS. 29 and 31 show the panel assembly 178 in a dislodged configuration at the intermediate position.

In some examples, the trailing section 182 comprises a thermally insulated core 186 contained within a relatively stiff outer shell 188 (panel frame). For the same reasons presented in describing the door 10, the outer shell 188 is stiffer than the core 186, is heavier or sturdier than the core 186, and has a lower R-value than the core 186. In some examples, the trailing section 182 includes structural means for supporting a plurality of resilient stays 190 that extend in a cantilevered manner from the outer shell 188. In this example, the leading section 180 comprises a thermally insulated core 192 with an optional nose seal 194. A pliable covering 196 overlies the outer shell 188, the cores 186, 192, and the stays 190. In some examples, the covering 196 also covers and/or contributes to the structure of the nose seal 194. The trailing section 182 may be relatively stiff to withstand high forces of acceleration during rapid door operation. In some examples, the leading section 180 may be more flexible to resiliently deform in response to an impact. In some examples, the bottom seal unitarily extends across the trailing section 182 and the leading section 180. In some such examples, the bottom seal is flexible to deform or bend with the leading section 180. To cover the portion of the panel assembly 178 that is most exposed and vulnerable to an impact, in some examples, a leading width 198 of the leading section 180 is at least twenty percent a trailing width 200 of the trailing section 182. In other words, the leading section 180 may be at least one-fifth as wide as the trailing section 182.

Figure 32:
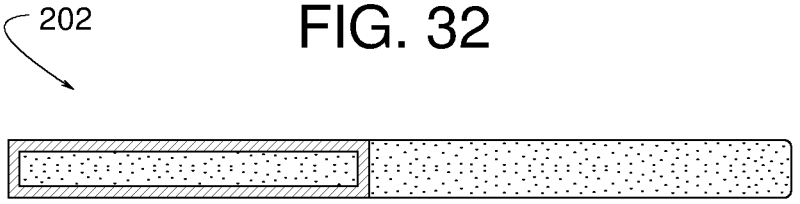
FIG. 32 is a cross-sectional view similar to FIG. 30 but showing another example door constructed in accordance with the teachings disclosed herein.
Figure 33:
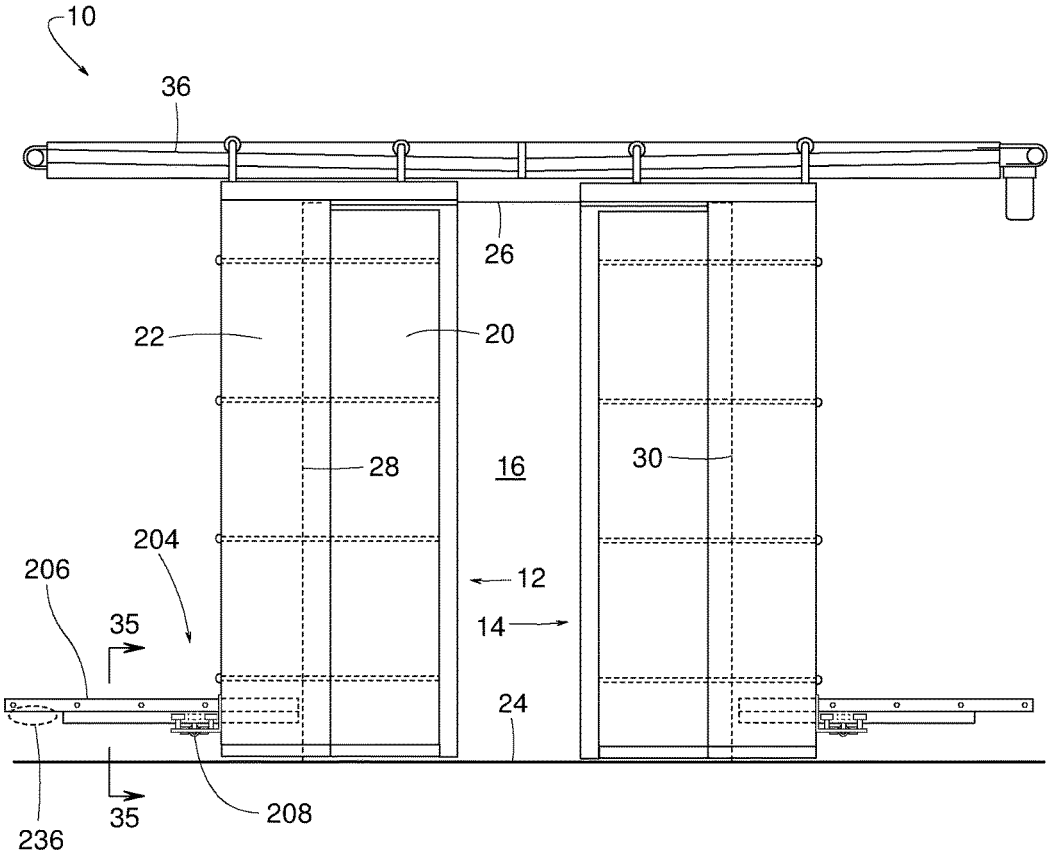
FIG. 33 is a front view similar to FIGS. 3 and 28 but showing an example door at an intermediate position and having an example spring loaded roller mechanism constructed in accordance with the teachings disclosed herein.
Figure 34:
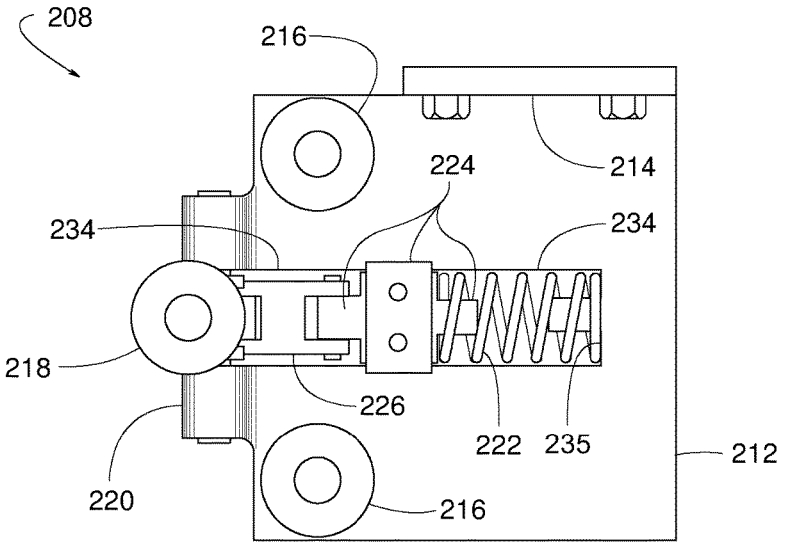
FIG. 34 is a top view of the example roller mechanism shown in FIG. 33.
Figure 35:
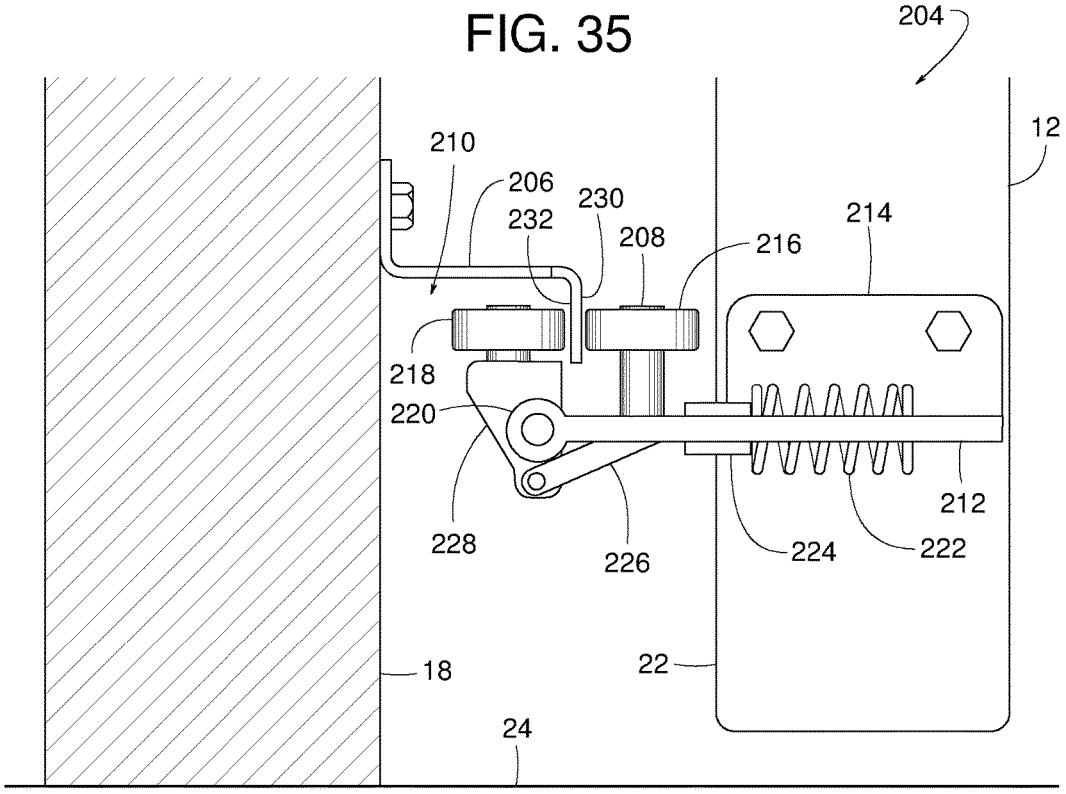
FIG. 35 is a cross-sectional view taken along line 35-35 of FIG. 33, wherein an example spring loaded roller is shown in a guiding configuration.

FIG. 32 shows a panel assembly 202 that is similar to the panel assembly 178 but slightly modified. In the example panel assembly 202, the stays 190 and the nose seal 194 are eliminated; otherwise, panel assemblies 178 and 202 are virtually the same.

FIGS. 33-38 show an example spring loaded roller system 204 that helps guide the door panels 20, 22 along the door panels' normal travel path 34 as the door 10 opens and closes. In the illustrated example, the system 204 includes a lower track 206 and a roller mechanism 208, both of which are below the overhead track 36. The lower track 206 defines a roller passageway 210 and helps guide the travel motion of the roller mechanism 208. In the illustrated example, the lower track 206 is attached to the wall 18 at some elevation above the floor 24 to avoid adding clutter or tripping hazards on the floor 24. In other examples, however, the lower track 206 is mounted to the floor 24. The roller mechanism 208 may be attached to each door panel assembly 12, 14.

Figure 36:
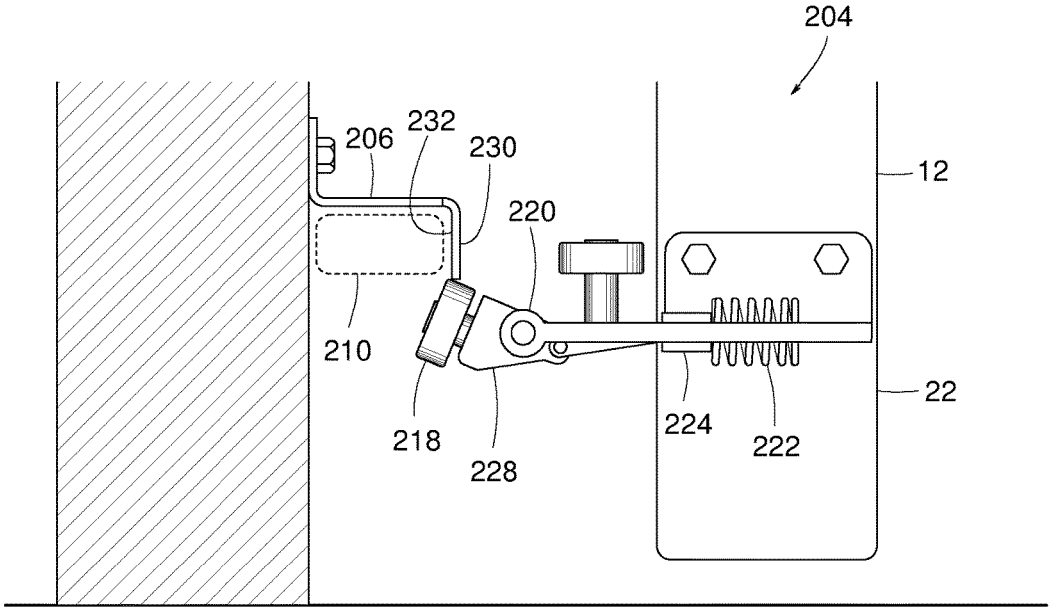
FIG. 36 is a cross-sectional view similar to FIG. 35 but showing the example spring loaded roller in a release configuration.

In the illustrated example, the roller mechanism 208 comprises a base plate 212, a flange 214, at least one front roller 216, a spring loaded roller 218, a hinge 220, a compression spring 222, a slider 224, a link 226, and a pivot arm 228. In this example, the flange 214 extends from the base plate 212 to provide means for mounting the roller mechanism 208 to the door panel 22. The two front rollers 216 on the base plate 212 roll along a front surface 230 of the lower track 206. The hinge 220 pivotally connects the pivot arm 228 to the base plate 212. The pivot arm 228 supports the spring loaded roller 218 such that the spring loaded roller 218 can pivot between a guiding configuration (FIG. 35) and a release configuration (FIG. 36). In the guiding configuration, the spring loaded roller 218 extends into the roller passageway 210 of the track 206 and rolls along the track's back surface 232. In the release configuration, the spring loaded roller 218 is outside of the track's roller passageway 210.

As shown in the illustrated example, the link 226 pivotally connects the pivot arm 228 to the slider 224, which slides along a slot 234 in the base plate 212. The compression spring 222 within the slot 234 urges the slider 224 away from a closed end 235 of the slot 234. Urging the slider 224 in this direction forces the link 226 to urge the spring loaded roller 218 to its guiding configuration. Thus, the spring 222 being in compression provides the energy to urge the spring loaded roller 218 to its guiding configuration. The spring 222 being compressible, however, allows the spring loaded roller 218 to be forcefully pushed to its release configuration during an impact of the door 10.

Figure 37:
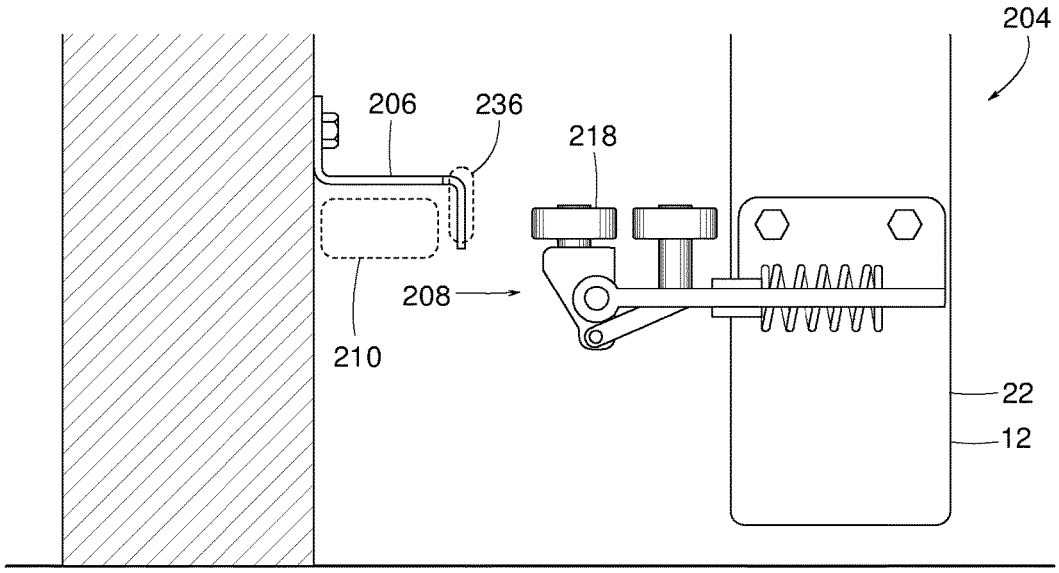
FIG. 37 is a cross-sectional view similar to FIGS. 35 and 36 but showing the example spring loaded roller mechanism having completely separated from an example lower track constructed in accordance with the teachings disclosed herein.

When an impact forces the panel assembly 12 from its normal configuration (FIG. 35) to its dislodged configuration (FIG. 36), the resulting force of impact can be sufficient to overcome the spring 222 and force the spring loaded roller 218 to pivot to its release configuration, which allows the panel 22 to become fully dislocated to the position shown in FIG. 37 without damaging the door 10 nor the spring loaded roller system 204.

Once the panel 22 is in the dislodged configuration shown in FIG. 37, the panel 22 is automatically returned to its normal configuration by slowing the opening of the door 10. When the door panel 22 reaches its fully open position (e.g., FIG. 1), the weight of the hanging door panel 22 urges spring loaded roller 218 to pass back through an opening 236 in the lower track 206. In some examples, the opening 236 corresponds to an area beyond an end of the lower track 206 (e.g., the lower track 206 is shorter than a distance travelled by the spring loaded roller 218). This places the spring loaded roller 218 back in line with the roller passageway 210 so that the door 10 is restored to normal operating conditions for the door's next closing cycle.

Figure 38:
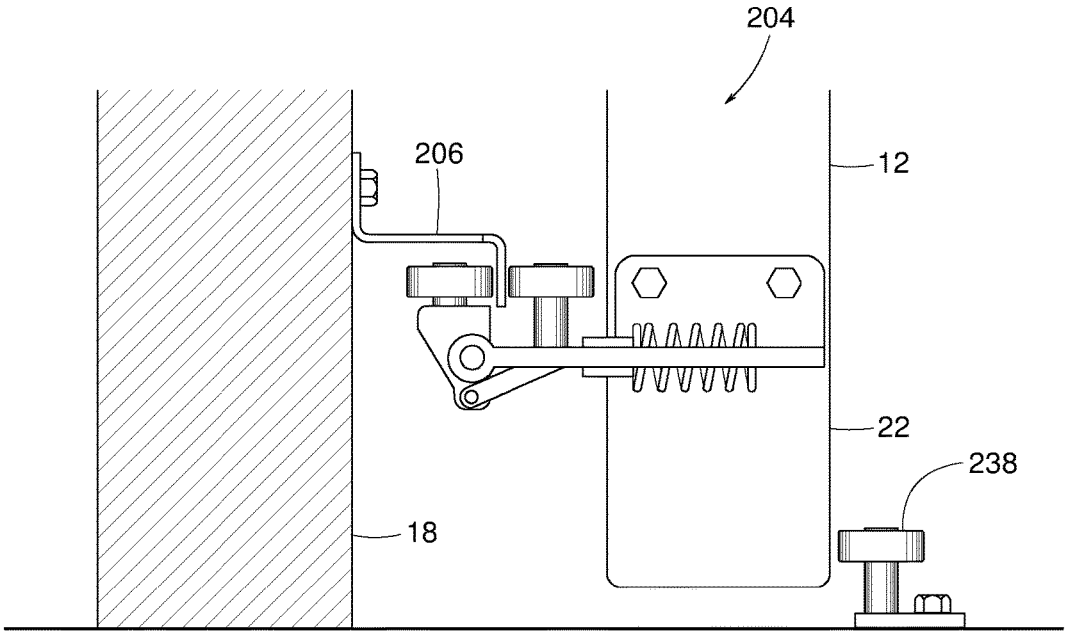
FIG. 38 is a cross-sectional view similar to FIG. 35 but with the addition of an example return roller constructed in accordance with the teachings disclosed herein.
Figure 39:
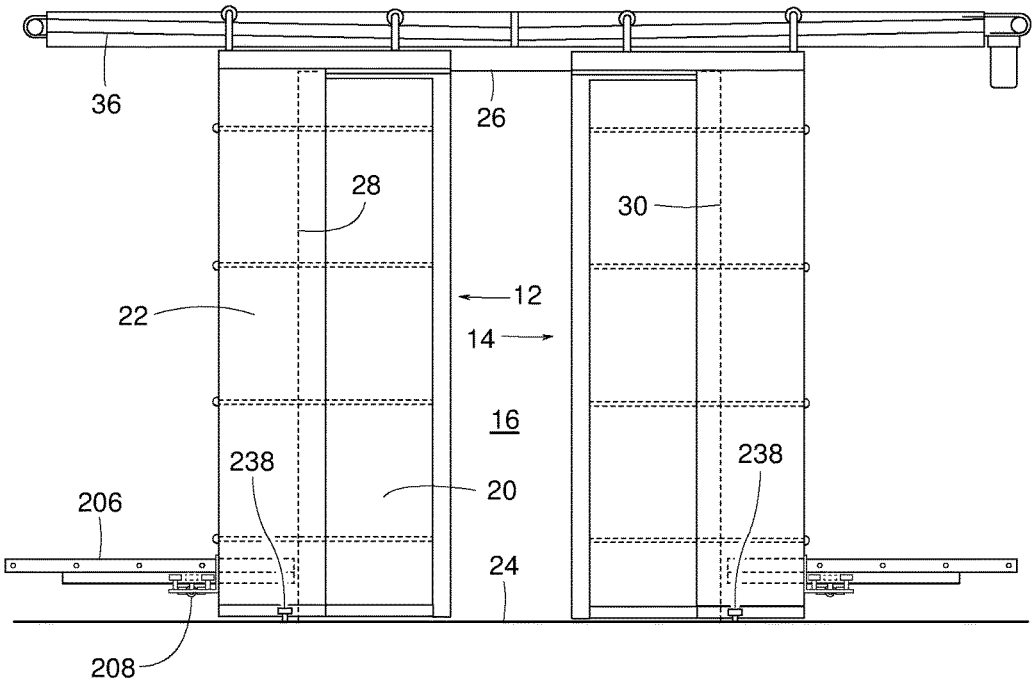
FIG. 39 is a front view similar to FIG. 33 but with the addition of the example return roller shown in FIG. 38.
Figure 40:
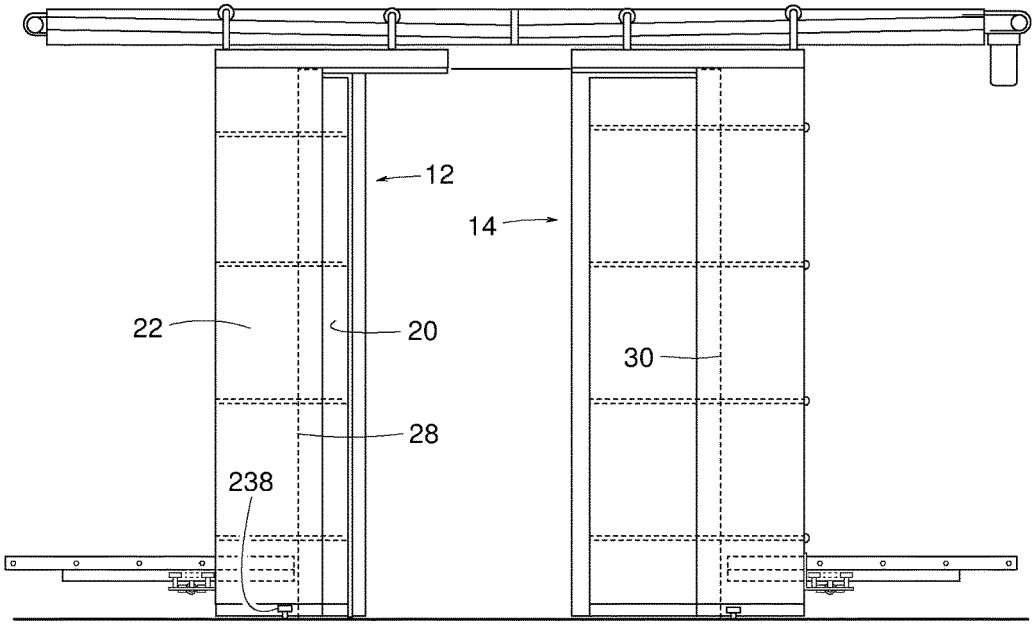
FIG. 40 is a front view similar to FIG. 39 but showing one of the example panel assemblies in a dislodged configuration.

Rather than relying solely on the swinging weight of the panel assembly 12 to return the spring loaded roller 218 to its guiding configuration, some examples of the spring loaded system 204, as shown in FIGS. 38-40, include a floor-mounted return roller 238. In some examples, the return roller 238 is mounted immediately in front of the panel assembly 12 near the lateral edge 28 of the doorway 16 so the return roller 238 forcefully urges the spring loaded roller 218 back through the opening 236 and into the roller passageway 210 as the panel assembly 12 reaches its fully open position. FIG. 39 shows the door 10 in its intermediate position and normal configuration, and FIG. 40 shows the door 10 in its intermediate position and dislodged configuration.

Figure 41:
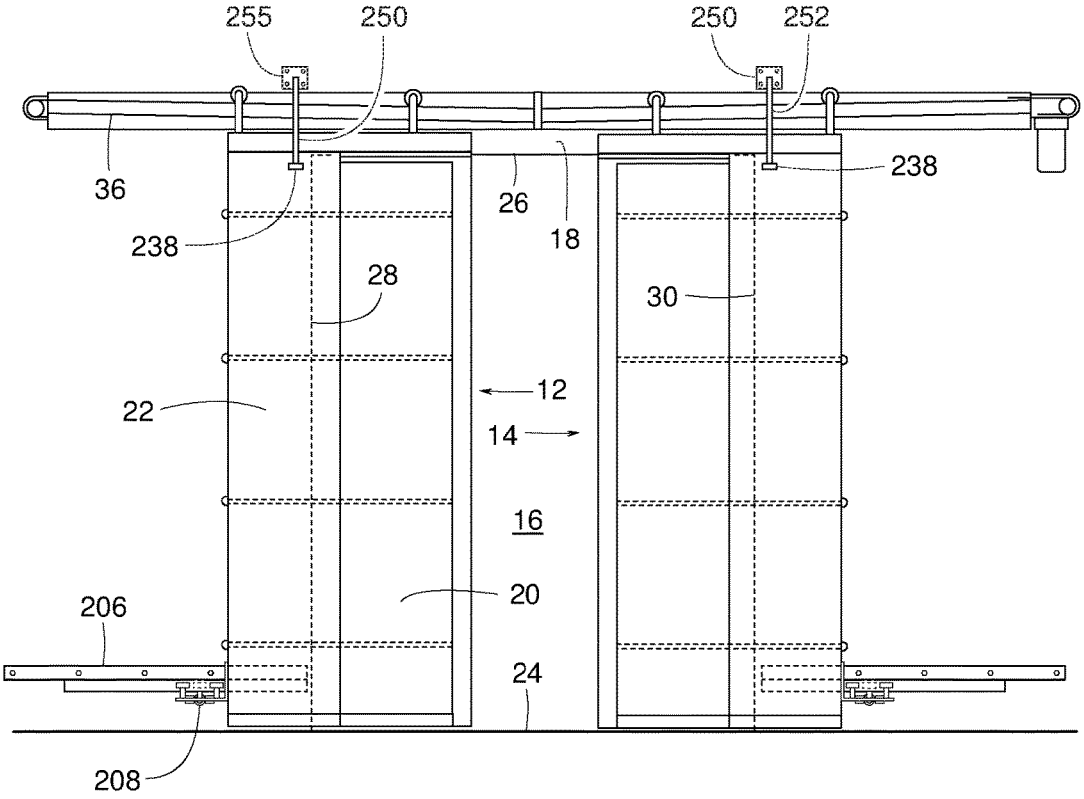
FIG. 41 is a front view similar to FIG. 39 but showing the example return roller mounted at an alternate location.

FIG. 41 shows a bracket 250 mounting the return roller 238 at an alternate location near the top of the door, whereby the roller 238 is more out of the way. In this example, the bracket 250 includes an arm 252 that connects the roller 238 to a mounting plate 255 attached to the wall 18. In some examples, the arm 252 extends out in front of the track 36 so as not to interfere with the carriage's rollers 52.

Figure 45:
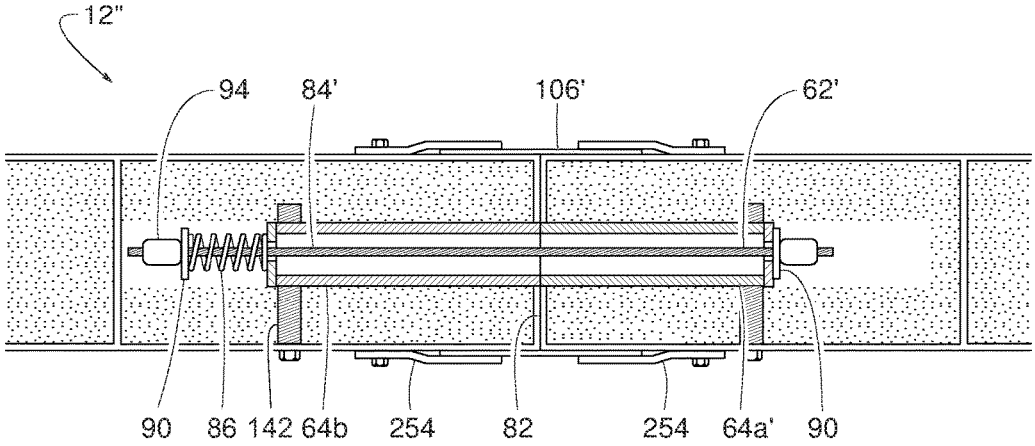
FIG. 45 is a cross-sectional view similar to FIG. 13 but showing a different example panel joint and tension member constructed in accordance with the teachings disclosed herein.
Figure 46:
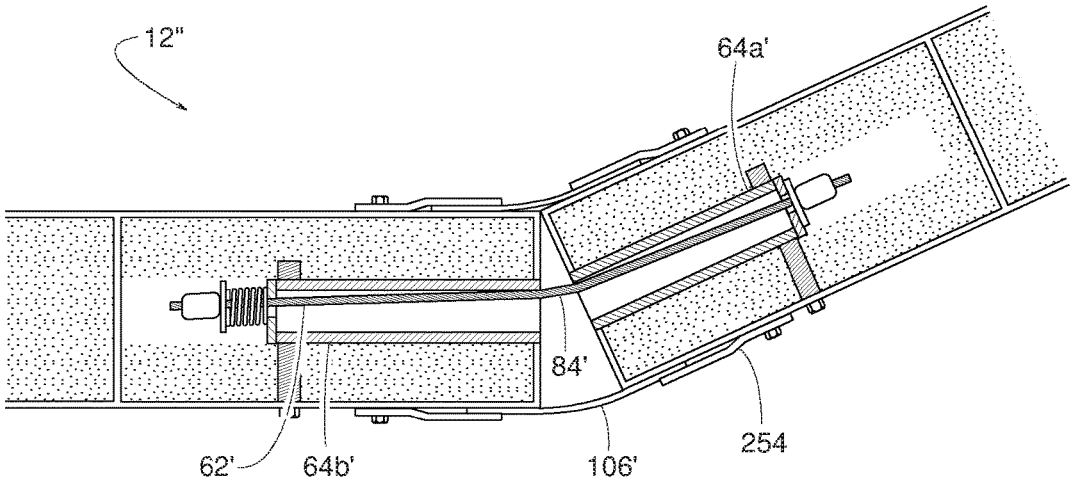
FIG. 46 is a cross-sectional view similar to FIG. 45 but showing the example joint in a dislodged configuration.

In some examples, as shown in FIGS. 45 and 46, an example panel assembly 12" includes an example tension member 62' that is similar to the tension member 62 discussed above. However, the tension member 62' of FIGS. 45 and 46 and its cable 84' do not extend across the full width of the panel assembly 12", thus reducing door weight and saving material costs. In this example, the tubes **64*a*', 64*b*' replace the tubes 64*a*, 64*b*, respectively. As shown in the illustrated example, the tubes 64*a*', 64*b*' are held in place with one or more interior mounting blocks 142** fastened to one or both faces of the trailing and leading panels. Thus, while the tension member may span the full width of each of the panels in some examples, in other examples, the tension member extends less than the full width of each panel but at least half the width of each panel. In other examples, the tension member may extend less than half the width of each panel. In some examples, the tension may extend different extents through each of the panels. For example, the tension member may extend substantially the entire width of one of the panels while extending less than the full width through the other panel. In some examples, other than the points of attachment at each end of the tension members, the entire tensioning mechanism is enclosed within the panels so as not to be exposed to the exterior environment. This may improve the appearance of the doors, protect the tension members and/or other components from damage, and/or protect people from being injured by the components.

In addition or alternatively, the panel assembly 12" includes a different style of shield and mounting arrangement. In this example, a shield 106' does not include the beads 112 of the shield 106 (FIGS. 13 and 14), which simplifies manufacturing. Also, instead of the channels 108 (FIGS. 13 and 14), the panel assembly 12" of FIGS. 45 and 46 includes mounting strips 254 that help hold the shield 106' in position covering joint 82. As the panel assembly 12" moves from a normal position shown in FIG. 45 to that of a dislodged position shown in FIG. 46, the shield 106' slides horizontally within the space between the strips 254 and the panel assembly 12".

Figure 42:
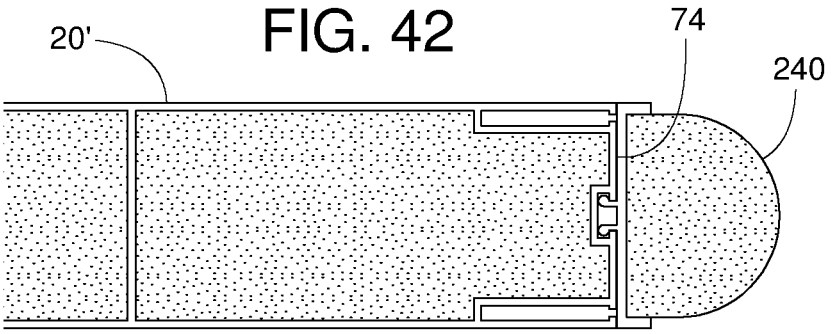
FIG. 42 is a cross-sectional top view of an example breakaway nose seal attached to the leading edge of an example panel assembly constructed in accordance with the teachings disclosed herein.
Figure 43:
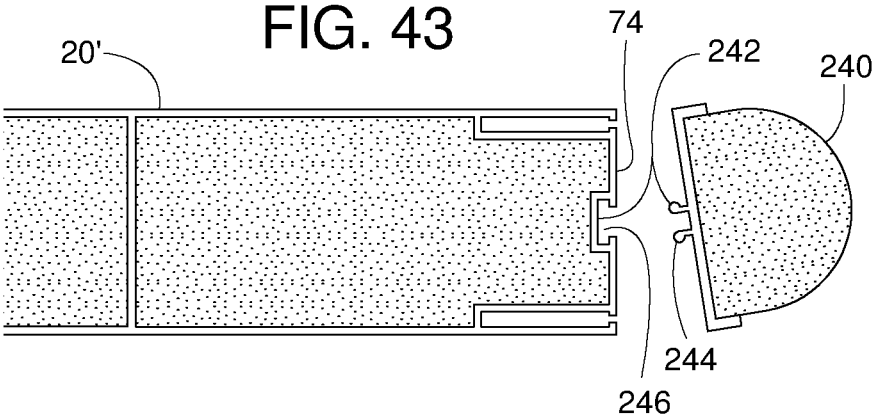
FIG. 43 is a cross-sectional view similar to FIG. 42 but showing the example nose seal in a breakaway position.
Figure 44:
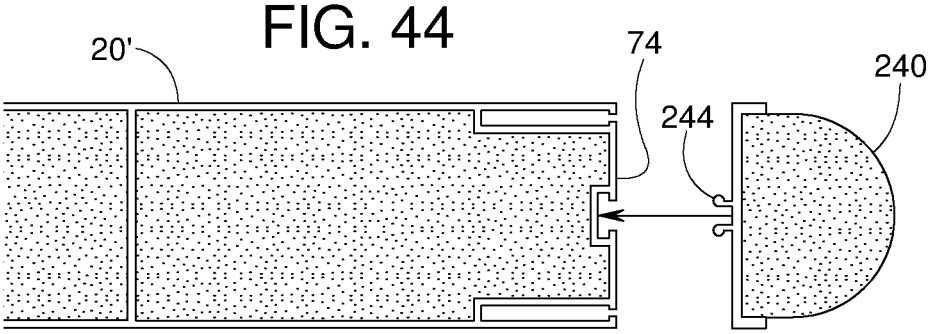
FIG. 44 is a cross-sectional view similar to FIG. 43 but with an arrow showing the example nose seal being moved in a horizontal direction from a breakaway position to an attached position.

In addition or alternatively, some door examples include a restorable breakaway nose seal 240 that releasably snaps onto the leading edge 74 of the leading panel 20', as shown in FIGS. 42-44. In this example, a resilient snap-in connection 242 releasably connects the nose seal 240 to the leading edge 74. In response to an impact, the resilient snap-in connection 242 renders the nose seal 240 movable in a horizontal direction between an attached position (FIG. 42) and a breakaway position (FIGS. 43 and 44). Being able to reconnect the nose seal 240 by moving it in a horizontal direction is important, as often there is insufficient vertical clearance to install the rather long nose seal 240 lengthwise into a vertically elongate groove. In some examples, the nose seal 240 is affixed to the leading edge 74 when the nose seal 240 is in the attached position, and the nose seal 240 is restorably separated from the leading edge 74 when the nose seal 240 is in the breakaway position. In the illustrated example, the snap-in connection 242 includes a resilient protrusion 244 that matingly fits within a vertically elongate groove 246 in the leading edge 74.

It should be noted that the term, "R-value" is a measure of a material's resistance to heat flow per thickness through a given area of the material, wherein the higher the R-value, the higher the material's resistance is to heat flow. The term, "generally horizontally" as it pertains to the movement of a door panel means that the panel moves away from a first lateral edge of the doorway toward a second lateral edge of the doorway. In some examples, such movement is perfectly horizontal and parallel to the floor. In some examples, the movement is at less than a ten degree incline relative to the floor. The term, "generally vertically" as it pertains to the movement of a door panel means that a leading edge of the door panel moves up and down in front of the doorway.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A door for use at a doorway through a wall, the doorway having a height extending in a vertical direction between a floor and an upper edge of the doorway, the doorway having a width extending in a horizontal direction between a first lateral edge of the doorway and a second lateral edge of the doorway, the door comprising:

a first panel assembly including a leading panel and a trailing panel, the first panel assembly is movable selectively between an open position and a closed position relative to the doorway, the first panel assembly blocks more of the doorway when the first panel assembly is in the closed position than when the first panel assembly is in the open position, the first lateral edge of the doorway is closer to the leading panel when the first panel assembly is in the open position than when the first panel assembly is in the closed position, the second lateral edge of the doorway being closer to the leading panel when the first panel assembly is in the closed position than when the first panel assembly is in the open position, the first panel assembly having a front face and a back face, the front face faces away from the wall, the back face faces toward the wall, the first panel assembly having selectively a normal configuration and a dislodged configuration, the leading panel is in substantially coplanar alignment with the trailing panel when the first panel assembly is in the normal configuration, the leading panel is angularly displaced out of the coplanar alignment with the trailing panel when the first panel assembly is in the dislodged configuration, the leading panel is angularly displaced out of the coplanar alignment with the trailing panel by the leading panel pivoting relative to the trailing panel without a hinge or pin to guide the pivoting; and a tension member connecting the leading panel to the trailing panel, the tension member resiliently urges the leading panel and the trailing panel toward each other, the tension member is adapted to resiliently urge the first panel assembly toward the normal configuration when the first panel assembly is in the dislodged configuration, the tension member extends through a first outer shell of the leading panel and through a second outer shell of the trailing panel.

2. The door of claim 1, wherein the dislodged configuration includes a first displaced arrangement and a second displaced arrangement, the leading panel being angularly displaced away from the doorway when the first panel assembly is in the dislodged configuration in the first displaced arrangement, and the leading panel being angularly displaced toward the doorway when the first panel assembly is in the dislodged configuration in the second displaced arrangement.

3. The door of claim 1, wherein the tension member extends through both the leading panel and the trailing panel, the tension member is disposed between the front face and the back face of the first panel assembly.

4. The door of claim 1, wherein the tension member is in greater tension when the first panel assembly is in the dislodged configuration than when the first panel assembly is in the normal configuration.

5. The door of claim 1, wherein the tension member compresses the leading panel and the trailing panel in the horizontal direction.

6. The door of claim 1, wherein the tension member includes a compression spring tensioning a horizontally elongate member.

7. The door of claim 1, wherein the tension member is more flexible than the leading panel and more flexible than the trailing panel.

8. The door of claim 1, wherein the tension member includes a cable.

9. The door of claim 1, wherein the tension member is elastic.

10. The door of claim 1, wherein the tension member includes a leading end and a trailing end, the door further including:

a leading tube extending through the leading panel; and a trailing tube extending through the trailing panel, the trailing tube substantially collinear with the leading tube when the first panel assembly is in the normal configuration, the leading end of the tension member being proximate a leading edge of the leading panel, the trailing end of the tension member being proximate a trailing edge of the trailing panel, and the tension member extending through both the leading tube and the trailing tube.

11. The door of claim 1, wherein the tension member extends from approximately a leading edge of the leading panel to approximately a trailing edge of the trailing panel.

12. The door of claim 1, wherein the tension member includes a plurality of tension members, the plurality of tension members being vertically spaced apart within the first panel assembly, each tension member of the plurality of tension members resiliently urging the leading panel toward the trailing panel, each tension member of the plurality of tension members resiliently urging the first panel assembly toward the normal configuration when the first panel assembly is in the dislodged configuration.

13. The door of claim 12, wherein the front face of the first panel assembly is closer to some tension members of the plurality of tension members than to other tension members of the plurality of tension members.

14. The door of claim 1, wherein the first outer shell of the leading panel contains a first insulated core and the second outer shell of the trailing panel contains a second insulated core, the first and second outer shells having a lower R-value than that of the first and second insulated cores, and the tension member to extend through the first and second outer shells and through the first and second insulated cores.

15. The door of claim 1, further including a tongue-and-groove joint extending vertically between the leading panel and the trailing panel.

16. The door of claim 1, further including a second panel assembly, the first panel assembly moving toward the second panel assembly when the first panel assembly moves from the open position toward the closed position, the first panel assembly moving away from the second panel assembly when the first panel assembly moves from the closed position toward the open position.

17. The door of claim 1, further including an overhead track proximate the upper edge of the doorway, wherein the first panel assembly is suspended from the overhead track.

18. The door of claim 1, further including a support member extending from the trailing panel, the leading panel rests upon the support member, the leading panel is adapted to pivot relative to the support member as the first panel assembly changes from the normal configuration to the dislodged configuration.

19. A door for use at a doorway through a wall, the doorway having a height extending in a vertical direction between a floor and an upper edge of the doorway, the doorway having a width extending in a horizontal direction between a first lateral edge of the doorway and a second lateral edge of the doorway, the door comprising:

an overhead track;

a carriage adapted to be supported by and movable along the overhead track;

a trailing panel having a trailing panel weight, the trailing panel is adapted to be suspended from the carriage such that the carriage carries most of the trailing panel weight;

a leading panel having a leading panel weight, the leading panel is connected to the trailing panel along a vertical edge of the trailing panel such that the trailing panel carries most of the leading panel weight, the trailing panel and the leading panel defining a panel assembly that is movable selectively between an open position and a closed position relative to the doorway, the panel assembly blocks more of the doorway when the panel assembly is in the closed position than when the panel assembly is in the open position, the first lateral edge of the doorway is closer to the leading panel when the panel assembly is in the open position than when the panel assembly is in the closed position, the second lateral edge of the doorway is closer to the leading panel when the panel assembly is in the closed position than when the panel assembly is in the open position, the panel assembly having selectively a normal configuration and a dislodged configuration, the leading panel is in substantially coplanar alignment with the trailing panel when the panel assembly is in the normal configuration, the leading panel is angularly displaced out of the coplanar alignment with the trailing panel when the panel assembly is in the dislodged configuration, the leading panel is held in the substantially coplanar alignment with the trailing panel so that the leading panel is able to rotate to the dislodged configuration without a hinge pin to guide the angular displacement; and a horizontally extending tension member to connect the leading panel to the trailing panel, the tension member resiliently urges the leading panel toward the trailing panel and resiliently urges the panel assembly toward the normal configuration when the panel assembly is in the dislodged configuration.

20. The door of claim 19, wherein the tension member is in greater tension when the panel assembly is in the dislodged configuration than when the panel assembly is in the normal configuration.

21. The door of claim 19, wherein the tension member includes a compression spring holding a horizontally elongate member in tension.

22. The door of claim 19, wherein the tension member includes a cable.

23. The door of claim 19, wherein the tension member includes a leading end and a trailing end, the door further including:

a leading tube extending through the leading panel; and a trailing tube extending through the trailing panel, the trailing tube is substantially collinear with the leading tube when the panel assembly is in the normal configuration, the leading end of the tension member is proximate a leading edge of the leading panel, the trailing end of the tension member is proximate a trailing edge of the trailing panel, and the tension member extends through both the leading tube and the trailing tube.

24. The door of claim 19, further including a support member extending from the trailing panel proximate the floor, the leading panel rests upon the support member, the leading panel pivots relative to the support member as the panel assembly changes from the normal configuration to the dislodged configuration.

* * * * *